US009200230B2

(12) United States Patent
Youn et al.

(10) Patent No.: US 9,200,230 B2
(45) Date of Patent: Dec. 1, 2015

(54) LUBRICATING COMPOSITIONS AND METHODS OF USE THEREOF

(71) Applicant: VORA Inc., Hayward, CA (US)

(72) Inventors: Minkoo Youn, San Jose, CA (US); Janghee Han, San Jose, CA (US)

(73) Assignee: VORA Inc., Hayward, CA (US)

( * ) Notice: Subject to any disclaimer, the term of this patent is extended or adjusted under 35 U.S.C. 154(b) by 7 days.

(21) Appl. No.: 13/783,156

(22) Filed: Mar. 1, 2013

(65) Prior Publication Data

US 2014/0249061 A1 Sep. 4, 2014

(51) Int. Cl.

*C10M 141/04* (2006.01)
*C10M 169/04* (2006.01)
*C10M 111/04* (2006.01)

(52) U.S. Cl.

CPC ..... *C10M 141/04* (2013.01); *C10M 111/04* (2013.01); *C10M 169/04* (2013.01); *C10M 2205/0206* (2013.01); *C10M 2207/026* (2013.01); *C10M 2207/028* (2013.01); *C10M 2207/2815* (2013.01); *C10M 2207/2835* (2013.01); *C10M 2209/084* (2013.01); *C10M 2211/022* (2013.01); *C10M 2215/064* (2013.01); *C10M 2223/045* (2013.01); *C10N 2230/02* (2013.01); *C10N 2230/06* (2013.01); *C10N 2240/10* (2013.01)

(58) Field of Classification Search

CPC ..... C10M 141/04; C10M 111/04; C10M 169/04; C10M 2205/0206; C10M 2207/026; C10M 2207/028; C10M 2207/2815; C10M 2207/2835; C10M 2209/084; C10M 2211/022; C10M 2215/064; C10M 2223/045; C10N 2230/02; C10N 2230/06; C10N 2240/10

USPC ..... 508/459, 563, 585, 110

See application file for complete search history.

(56) References Cited

U.S. PATENT DOCUMENTS

| | | | | |
|---|---|---|---|---|
| 2,682,523 | A | 6/1954 | Talley et al. | |
| 4,200,543 | A * | 4/1980 | Liston et al. | 508/338 |
| 4,534,873 | A * | 8/1985 | Clark | 508/159 |
| 4,844,825 | A | 7/1989 | Sloan | |
| 4,877,557 | A | 10/1989 | Kanashige et al. | |
| 5,332,516 | A | 7/1994 | Stephens | |
| 5,378,249 | A * | 1/1995 | Morrison | 44/388 |
| 5,523,007 | A | 6/1996 | Kristen et al. | |
| 5,558,802 | A | 9/1996 | Dowling | |
| 5,567,342 | A | 10/1996 | Inoue et al. | |
| 5,614,483 | A | 3/1997 | Fessenbecker et al. | |
| 5,622,924 | A | 4/1997 | Sakai et al. | |
| 5,631,211 | A | 5/1997 | Nakagawa et al. | |
| 5,723,419 | A * | 3/1998 | Czerwinski et al. | 508/589 |
| 5,726,133 | A | 3/1998 | Blahey et al. | |
| 5,728,656 | A | 3/1998 | Yamaguchi et al. | |
| 5,780,398 | A | 7/1998 | King et al. | |
| 5,792,732 | A | 8/1998 | Jao et al. | |
| 5,858,932 | A | 1/1999 | Dasai et al. | |
| 5,912,214 | A | 6/1999 | Zehler et al. | |
| 5,922,654 | A | 7/1999 | Yamazaki et al. | |
| 6,054,419 | A | 4/2000 | Le Coent | |
| 6,090,758 | A | 7/2000 | Pillon et al. | |
| 6,090,989 | A | 7/2000 | Trewella et al. | |
| 6,107,259 | A | 8/2000 | Muir et al. | |
| 6,140,283 | A | 10/2000 | Koganei | |
| 6,159,911 | A | 12/2000 | Katafuchi | |
| 6,245,719 | B1 | 6/2001 | Kobori | |
| 6,245,721 | B1 * | 6/2001 | Chun et al. | 508/151 |
| 6,313,077 | B1 | 11/2001 | Stunnenberg et al. | |
| 6,333,298 | B1 | 12/2001 | Waddoups et al. | |
| 6,521,570 | B2 | 2/2003 | Ostyn et al. | |
| 6,521,571 | B1 | 2/2003 | Garner et al. | |
| 6,610,636 | B2 | 8/2003 | Berlowitz et al. | |
| 6,642,189 | B2 | 11/2003 | Kurihara et al. | |
| 6,645,922 | B2 | 11/2003 | Dunn et al. | |
| 6,649,576 | B2 | 11/2003 | Bell et al. | |
| 6,660,697 | B2 | 12/2003 | Dunn et al. | |
| 6,720,294 | B1 | 4/2004 | Willars et al. | |
| 6,723,685 | B2 | 4/2004 | Hartley et al. | |
| 6,750,184 | B2 | 6/2004 | Ribeaud et al. | |
| 6,824,671 | B2 | 11/2004 | Goze et al. | |
| 7,018,962 | B2 | 3/2006 | Bloch et al. | |
| 7,141,157 | B2 | 11/2006 | Rosenbaum et al. | |
| 7,307,048 | B2 | 12/2007 | Sagawa et al. | |
| 7,399,734 | B2 | 7/2008 | Grabowski et al. | |
| 7,419,941 | B2 | 9/2008 | Waynick | |
| 7,462,583 | B2 | 12/2008 | Wilk et al. | |
| 7,538,076 | B2 | 5/2009 | Brown et al. | |
| 7,615,519 | B2 | 11/2009 | Esche, Jr. et al. | |
| 7,732,385 | B2 | 6/2010 | Yagishita | |

(Continued)

OTHER PUBLICATIONS

Sunoco, Properties of Sunpar range oils, retrieved from the internet at <http://www.sunoco.be/PDF/UK/TDSUKsunpar%20range.pdf> on Nov. 12, 2014.*

Calumet, Calsol Naphthenic Process Oils, retrieved from the internet at <http://www.calumetlubricants.com/images/pdf/Calsol_Process_Oils.pdf> on Nov. 12, 2014.*

"A-8016," Material Safety Data Sheet, Sanyo Chemical Industries, Ltd. (2006).

"A-8019," Material Safety Data Sheet, Sanyo Chemical Industries, Ltd. (2006).

"Additin® RC 7001," Technical Data Sheet, RheinChemie, Germany, 3 pages (2012).

"Additin® RC 7115 33B," article No. 14100923, Material Safety Data Sheet, Rhein Chemie Corporation, United States (2008).

(Continued)

*Primary Examiner* — James Goloboy

(74) *Attorney, Agent, or Firm* — Sterne, Kessler, Goldstein & Fox P.L.L.C.

(57) ABSTRACT

Described are various formulations of lubricant additive composition comprising an additive base oil, a chlorinated paraffin, and a first antioxidant that can be used as a stand-alone lubricant or can be used in an additive package that can be added to another lubricant composition (e.g., an engine oil, a transmission fluid, a turbine oil, a gear oil, a grease, etc.). Also described are various engine oil composition comprising the lubricant additive composition.

7 Claims, No Drawings

(56) References Cited

U.S. PATENT DOCUMENTS

| | | | | |
|---|---|---|---|---|
| 7,833,952 | B2 | 11/2010 | Devlin et al. | |
| 7,846,880 | B2 | 12/2010 | Rosenbaum et al. | |
| 7,879,775 | B2 | 2/2011 | Devlin et al. | |
| 7,902,133 | B2 | 3/2011 | Devlin et al. | |
| 7,906,465 | B2 | 3/2011 | Devlin et al. | |
| 7,910,530 | B2 | 3/2011 | Poirier | |
| 7,928,045 | B2 | 4/2011 | Dong et al. | |
| 8,071,518 | B2 | 12/2011 | Yagishita et al. | |
| 8,084,403 | B2 | 12/2011 | Lam et al. | |
| 8,093,190 | B2 | 1/2012 | Chase et al. | |
| 8,110,532 | B2 | 2/2012 | Dong | |
| 8,119,579 | B2 | 2/2012 | Habeeb et al. | |
| 2008/0318815 | A1 * | 12/2008 | Cherpeck et al. | 508/290 |

OTHER PUBLICATIONS

"Additin® RC 7115," Technical Data Sheet, RheinChemie, Germany, 2 pages (2010).

"Calcinate™ Calcium Overbased Sulfonates Additives for Industrial Lubricants," Chemtura Corporation, United States, 6 pages (2006).

"Cereclor™," Material Safety Data Sheet, INEOS Chlor, United States, 5 pages (2006).

"HiTec 7197G: Antiwear Agent for Greases," Industrial, Afton Chemical Corporation (2011).

"Lubrizol (R) 7075F," Material Safety Data Sheet, Lubrizol Corporation, United States, 5 pages (2001).

"Published Guidelines," Appendix E-API Base Oil Interchangeability Guidelines for Passenger Car Moto Oils and Diesel Engine Oils, American Petroleum Institution, United States (2011).

"PV1202," Engine Oils-dexos 1, API/ILSACE Technology: The PV1000 Series of Products, Lubrizol Corporation (2011).

"Synfluid® PAO 6cSt," Material Safety Data Sheet, Chevron Phillips, Chemical Company LP, Version 1.7, 9 pages (2011).

"Technical Bulletin: What are Chlorinated Paraffins?" U.S.A. All American, United States, 10 pages (printed Nov. 20, 2012).

"CA3685 TMP Trioleate," Material Safety Data Sheet, Chemical Associates, United States (2009).

"Yubase 8," Material Safety Data Sheet, SK lubricants, 9 pages (2011).

"Xiameter® PMX-200 Silicone Fluid, 350 cSt, Food Grade," product information, Xiameter, Dow Corning Corporation, 4 pages (2009).

International Search Report for International Application No. PCT/US2014/019541, ISA/US, Virginia, United States, mailed Jun. 6, 2014.

Totten, G.E., et al., "Fuels and Lubricants Handbook: Technology, Properties, Performance, and Testing," ASTM Manual Series: MNL 37, United States, table of contents only (2003).

Lynch T.R., "Process Chemistry of Lubricant Base Stocks," Speight, Ed., CRC Press, Taylor & Francis Group (2007).

* cited by examiner

LUBRICATING COMPOSITIONS AND METHODS OF USE THEREOF

BACKGROUND OF THE INVENTION

1. Field of the Invention

The present invention relates to lubricating compositions. The present invention further relates to methods of using the lubricating compositions, such as for high pressure metal-on-metal applications, for example, lubricating an engine.

2. Background of the Invention

Various lubricating compositions are known in the art. However, lubricants that have high boiling point, low freezing point, high viscosity index, good thermal stability, corrosion resistance, and/or high resistance to oxidation continue to be highly desired in the marketplace. Also desired are lubricating compositions that can have wide applications for different engines, machines, etc. and can perform well in different conditions.

There are different approaches described in the literature for improving the characteristics of a lubricant. Some of the approaches are directed to obtaining a base oil of special property for the lubricants. For example, U.S. Pat. No. 7,141,157 describes a process for preparing Fischer-Tropsch derived lubricating base oils; U.S. Pat. No. 6,824,671 describes poly-alpha-olefins having superior Noack volatility at low pour points. Some of the approaches are directed to providing a special additive component to the lubricants, such as an antioxidant, an anti-friction agent, an anti-wear agent, or a viscosity enhancer, etc. For example, U.S. Pat. No. 8,093,190 describes an antioxidant combination of a hindered amine and a metal compound; U.S. Pat. No. 7,018,962 provides a viscosity index (VI) improver concentrate; U.S. Pat. No. 5,723,419 discloses a composition with a chlorinated paraffin as an anti-friction agent; U.S. Pat. No. 7,615,519 discloses a composition comprising a hydrocarbon soluble titanium compound.

However, each of the above identified approaches has its own limitations. Thus, one objective of the present invention is to develop novel lubricating compositions that are superior to and/or more versatile than some of the existing lubricants.

BRIEF DESCRIPTION OF THE INVENTION

In embodiments, the invention provides a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition.

In embodiments, the invention provides a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition; and further comprising a second antioxidant in an amount of 0.01-5% by weight of the additive composition. In embodiments, the first antioxidant is an amine antioxidant or a phenol antioxidant. In embodiments, the second antioxidant is an amine antioxidant or a phenol antioxidant. In embodiments, the first antioxidant is an amine antioxidant and the second antioxidant is a phenol antioxidant.

In embodiments, the invention provides a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition; wherein the additive base oil is selected from the group consisting of a Group I base oil, a Group II base oil, a Group III base oil, a Group IV base oil, and a synthetic ester base oil. In embodiments, the lubricant additive composition further comprises at least one additional additive base oil in an amount of 1-50% by weight of the additive composition.

In embodiments, the invention provides a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition, and further comprises at least one additional component selected from the group consisting of an anti-wear agent, a detergent, a dispersant, a diluent, a demulsifier, an antifoam agent, a corrosion/rust inhibitor, an extreme pressure agent, a pour point depressant, a viscosity index improver, and a friction modifier.

In embodiments, the invention provides an engine oil comprising a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition. In embodiments, the engine oil is formulated for an internal combustion engine.

In embodiments, the invention provides a transmission oil comprising a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition.

In embodiments, the invention provides a gear oil comprising a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition.

In embodiments, the invention provides a turbine oil comprising a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition.

In embodiments, the invention provides a method of lubricating an engine comprising contacting the engine with an engine oil comprising a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition. In embodiments, the engine is an internal combustion engine.

In embodiments, the invention provides a method of enhancing fuel efficiency of an engine comprising providing to the engine an engine oil comprising a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition. In embodiments, the engine is an internal combustion engine.

In embodiments, the invention provides an engine oil comprising 5-25% by weight of an engine oil additive composition, wherein the additive composition comprises: a) a chlorinated paraffin in an amount of 30-35% by weight of the additive composition; and b) an additive base oil in an amount of 20-40% by weight of the additive composition; and wherein the engine oil is formulated for an engine selected from the group of a car engine, a motorcycle engine, a bus engine, a commercial vehicle engine, a boat engine, a jet engine, a helicopter engine, a truck engine, a marine diesel engine, a railroad diesel engine, an outboard motor engine, a generator engine, a tractor engine, a nondiesel railroad engine, an electric car engine, and an aviation piston engine.

DETAILED DESCRIPTION OF THE INVENTION

Lubricant Additive Composition

The inventors have discovered that a lubricant additive composition comprising an additive base oil, a chlorinated paraffin, and one or more antioxidant(s) has unique advantages in reducing friction between two surfaces (e.g., two metal moving surfaces).

Thus, in embodiments, the invention provides various formulations of a lubricant additive composition. In embodiments, the lubricant additive composition comprises an additive base oil, a chlorinated paraffin, and a first antioxidant. In embodiments, the lubricant additive composition further comprises a second antioxidant. In embodiments, the lubricant additive composition comprises more than one additive base oil. In embodiments, the lubricant additive composition further comprises at least one additional component selected from the group consisting of an anti-wear agent, a detergent, a dispersant, a diluent, a demulsifier, an antifoam agent, a corrosion/rust inhibitor, an extreme pressure agent, a pour point depressant, a viscosity index improver, and a friction modifier.

The lubricant additive compositions provided herein can be used as stand-alone lubricants or can be added to another lubricant composition (e.g., an engine oil, a transmission oil, a turbine oil, a gear oil, a grease, etc.).

The term "lubricant additive composition" therefore refers to a composition that can be used as a stand-alone lubricant, or as a composition that can have additional components added to it to form another lubricant composition. The term "additive base oil" therefore refers to the base oil that is added to form the lubricant additive composition. Once the lubricant additive composition is formed, however, additional components, such as additional base oil, can be added to the lubricant additive composition to form another lubricant composition.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. As used herein, "about" a specific value also includes the specific value, for example, about 10% includes 10%. The numerical ranges or values in all of the tables herein are to be understood to be prefaced by the term "about".

Formulation A: Additive Base Oil, Chlorinated Paraffin, and Antioxidant

In embodiments, the invention provides a lubricant additive composition comprising an additive base oil, a chlorinated paraffin, and a first antioxidant. Suitable additive base oil and the weight percentage thereof are described herein. Suitable chlorinated paraffin and the weight percentage thereof are described herein. Suitable antioxidant(s) and the weight percentage thereof are also described herein.

In any of the embodiments described herein, the additive base oil can be in an amount of about 10% to about 80%, about 10% to about 70%, about 10% to about 60%, about 10% to about 50%, about 10% to about 40%, about 10% to about 30%, about 10% to about 20%, about 20% to about 80%, about 20% to about 70%, about 20% to about 60%, about 20% to about 50%, about 20% to about 40%, about 20% to about 30%, about 30% to about 80%, about 30% to about 70%, about 30% to about 60%, about 30% to about 50%, about 30% to about 40%, about 40% to about 80%, about 40% to about 70%, about 40% to about 60%, about 40% to about 50%, about 50% to about 80%, about 50% to about 70%, about 50% to about 60%, about 60% to about 80%, about 60% to about 70%, about 70% to about 80%, more than 80% (e.g., about 80% to about 90%, about 90% to 95%, or more than 95%), or less than 10% by weight of the lubricant additive composition. In any of the embodiments described herein, the additive base oil can also be in an amount of about 10%, about 20%, about 30%, about 40%, about 50%, about 60%, about 70%, about 80%, about 90%, or about 95% by weight of the lubricant additive composition.

In any of the embodiments described herein, the chlorinated paraffin can be in an amount of about 10% to about 60%, about 10% to about 50%, about 10% to about 40%, about 10% to about 30%, about 10% to about 20%, about 15% to about 60%, about 15% to about 50%, about 15% to about 45%, about 15% to about 40%, about 15% to about 35%, about 15% to about 30%, about 20% to about 60%, about 20% to about 50%, about 20% to about 40%, about 20% to about 30%, about 30% to about 60%, about 30% to about 50%, about 30% to about 40%, about 40% to about 60%, about 40% to about 50%, about 50% to about 60%, less than 10% (e.g., about 5% to about 10%, or less than about 5%), or more than 60% (e.g., about 60% to about 70%, about 70% to about 80%, about 80% to about 90%, or more than about 90%) by weight of the lubricant additive composition. In any of the embodiments described herein, the chlorinated paraffin can also be in an amount of about 10%, about 20%, about 30%, about 40%, about 50%, about 60%, about 70%, about 80%, about 90%, or about 95% by weight of the lubricant additive composition.

In any embodiments described herein, the first antioxidant can be in an amount of about 0.01% to about 5%, about 0.01% to about 4%, about 0.01% to about 3%, about 0.01% to about 2%, about 0.01% to about 1%, about 0.1% to about 5%, about 0.1% to about 4%, about 0.1% to about 3%, about 0.1% to about 2%, about 0.1% to about 1%, about 0.5% to about 5%, about 0.5% to about 4%, about 0.5% to about 3%, about 0.5% to about 2%, about 0.5% to about 1%, or more than about 5% by weight of the lubricant additive composition. In any embodiments described herein, the first antioxidant can also be in an amount of about 0.01%, about 0.05%, about 0.1%, about 0.2%, about 0.3%, about 0.4%, about 0.5%, about 0.6%, about 0.7%, about 0.8%, about 0.9%, about 1%, about 1.5%, about 2%, about 3%, about 4%, or about 5% by weight of the lubricant additive composition.

In embodiments, the invention provides a lubricant additive composition comprising a) an additive base oil in an amount of 10-80% by weight of the additive composition; b) a chlorinated paraffin in an amount of 10-60% by weight of the additive composition; and c) a first antioxidant in an amount of 0.01-5% by weight of the additive composition. In embodiments, the chlorinated paraffin is in an amount of about 15 to about 45% by weight of the additive composition. Suitable additive base oil, chlorinated paraffin and first antioxidant are described herein.

Additive Base Oil

Suitable additive base oils for use in the lubricant additive composition of the invention include a mineral oil or a synthetic oil. Thus, in any embodiments described herein, the additive base oil can be a mineral oil or a synthetic oil. In embodiments, the additive base oil is a mineral oil. In embodiments, the additive base oil is a blend of more than one mineral oil. In embodiments, the additive base oil is a synthetic oil. In embodiments, the additive base oil is a blend of more than one synthetic oil. In embodiments, the additive base oil is a blend of a mineral oil and a synthetic oil. In embodiments, the additive base oil is a blend of more than one mineral oil and a synthetic oil. In embodiments, the additive base oil is a blend of a mineral oil and more than one synthetic oil. In embodiments, the additive base oil is a blend of more than one mineral oil and more than one synthetic oil.

Suitable additive base oils for use in the lubricant additive composition of the invention include a Group I base oil, a Group II base oil, a Group III base oil, a Group IV base oil, or a Group V base oil (e.g., a synthetic ester base oil). It is known in the art that base oil can be categorized into five general groups, i.e., Groups I-V, see e.g., Published Guidelines by American Petroleum Institution (the "API"): "Appendix E—API Base Oil Interchangeability Guidelines for Passenger Car Motor Oils and Diesel Engine Oils (September 2011)" (herein after "the API Guidelines"). The terms "a Group I base oil," "a Group II base oil," "a Group III base oil," "a Group IV base oil," and "a Group V base oil" herein refer to a base oil that falls within the category of Groups I-V base stock as defined in the API Guidelines, respectively. As used herein, the terms "base oil" and "base stock" are used interchangeably, unless otherwise differentiated.

According to the API Guidelines, each category of base stock has a specific characteristic chemical compositions (e.g., content of saturates, content of sulfur) and physical properties (e.g., viscosity index value). The lubricant industry extends the five basic categories in the API Guidelines and uses Group $I^+$, Group $II^+$, or Group $III^+$ base oil category to describe Group I base stocks that have a viscosity index of 103-108, Group II base stocks that have a viscosity index of 113-119; or Group III base stocks that have a viscosity index of at least 140, respectively.

In any of the embodiments described herein, the additive base oil can be selected from the group consisting of a Group I base oil, a Group II base oil, a Group III base oil, a Group IV base oil, and a synthetic ester base oil. In embodiments, the additive base oil can also be a Group $I^+$, Group $II^+$, or a Group $III^+$ base oil. In embodiments, the additive base oil is a Group III, a Group IV base oil, or a synthetic ester base oil. In embodiments, the additive base oil is a Group III base oil.

In embodiments, the additive base oil is a Group IV base oil. Group IV base oil includes poly-alpha-olefins ("PAO"). Thus, in embodiments, the additive base oil is a PAO base oil. PAOs with various viscosity are known, for example, low viscosity PAO, defined as having a kinematic viscosity at 100° C. of between 2-10 cSt; medium viscosity PAO, defined as having a kinematic viscosity at 100° C. of between 10-25 cSt; high viscosity PAO, defined as having a kinematic viscosity at 100° C. of between 25-100 cSt, and ultra-high viscosity PAO, defined as having a kinematic viscosity at 100° C. of between 150-1000 cSt. In embodiments, the additive base oil is a low viscosity PAO, a medium viscosity PAO, or a high viscosity PAO. In embodiments, the additive base oil is a low viscosity PAO. In embodiments, the additive base oil is a low viscosity PAO having a kinematic viscosity of about 2 to about 9, about 2 to about 8, about 2 to about 7, about 2 to about 6, about 2 to about 5, about 3 to about 10, about 3 to about 9, about 3 to about 8, about 3 to about 7, about 3 to about 6, about 3 to about 5, about 4 to about 10, about 4 to about 9, about 4 to about 8, about 4 to about 7, about 4 to about 6, about 4 to about 5, about 5 to about 10, about 5 to about 9, about 5 to about 8, about 5 to about 7, or about 5 to about 6 at 100° C. In embodiments, the additive base oil is a low viscosity PAO having a kinematic viscosity of about 2, about 3, about 4, about 6, about 7, about 8, about 9, or about 10 at 100° C.

Suitable additive base oils for use in the lubricant additive composition of the invention also include a synthetic ester base oil. Thus, in any embodiments described herein, the additive base oil can also be a synthetic ester base oil. In embodiments, the additive base oil is a hindered ester, a dicarboxylic ester, or a polyester. In embodiments, the additive base oil is a polyester (e.g., a diester, or a triester). In embodiments, the polyester has unreacted hydroxyl groups. In embodiments, the additive base oil is a polyester, wherein the polyester can be formed by reacting a polyol with a carboxylic acid. In embodiments, the polyol is a polyol having at least 3 hydroxyl groups and 3 to 10 carbons. In embodiments, the polyol is a neopentyl polyol selected from the group consisting of neopentyl glycol, trimethylolpropane, trimethylolethane, monopentaerythritol, ditrimethylolpropane, dipentaerythritol, tripentaerythritol, and tetrapenlaerythritol. In embodiments, the additive base oil is a polyester that can be formed by reacting trimethylopropane with a carboxylic acid. In embodiments, the carboxylic acid can be a saturated or unsaturated, linear or branched, carboxylic acid having 5 to 12 carbons, or more than 12 carbons (e.g., 14 carbons, 16 carbons, 18 carbons, 20 carbons, 22 carbons, or 24 carbons). In embodiments, the carboxylic acid is selected from the group consisting of palmitoleic acid, cis-vaccenic acid, oleic acid, pentanoic acid, hexanoic acid, heptanoic acid, octanoic acid, nonanoic acid, decanoic acid, undecanoic acid, dodecanoic acid, tridecanoic acid, myristic acid, pentadecylic acid, palmitic acid, margaric acid, stearic acid, nonadecylic acid, nonadecanoic acid, eicosanoic acid, heneicosanoic acid, docosanoic acid, tricosanoic acid, and tetracosanoic acid. In embodiments, the additive base oil is a trimethylolpropane trioleate polyester base oil.

Suitable additive base oils for use in the lubricant additive compositions of the invention also include paraffinic base oil, naphthenic base oil, and aromatic base oil, which are known in the art. Thus, in any of the embodiments described herein, the additive base oil can also be a paraffinic base oil, a naphthenic base oil, or an aromatic base oil. In embodiments, the additive base oil is a paraffinic base oil (e.g., a heavy paraffinic base oil).

Suitable additive base oils for use in the lubricant additive composition of the invention can be described by their physical characteristics. Thus, in any of the embodiments described herein, the additive base oil can be characterized by having a certain (e.g., as described herein) viscosity index, a kinematic viscosity at 100° C., an evaporated quantity by the NOACK volatility test, or any combination thereof. In embodiments, the additive base oil has a viscosity index of about 80 to about 180, about 80 to about 170, about 80 to about 160, about 80 to about 150, about 80 to about 140, about 80 to about 130, about 80 to about 120, about 80 to about 110, about 80 to about 100, about 80 to about 90, about 90 to about 180, about 90 to about 170, about 90 to about 160, about 90 to about 150, about 90 to about 140, about 90 to about 130, about 90 to about 120, about 90 to about 110, about 90 to about 100, about 100 to about 180, about 100 to about 170, about 100 to about 160, about 100 to about 150, about 100 to about 140, about 100 to about 130, about 100 to about 120, about 100 to about 110, about 110 to about 180, about 110 to about 170, about 110 to about 160, about 110 to about 150, about 110 to about 140, about 110 to about 130, about 110 to about 120, about 120 to about 180, about 120 to about 170, about 120 to about 160, about 120 to about 150, about 120 to about 140, about 120 to about 130, about 130 to about 180, about 130 to about 170, about 130 to about 160, about 130 to about 150, about 130 to about 140, about 140 to about 180, about 140 to about 170, about 140 to about 160, about 140 to about 150, about 150 to about 180, about 150 to about 170, about 150 to about 160, about 160 to about 180, about 160 to about 170, about 170 to about 180, or more than 180. In embodiments, the additive base oil has a viscosity index of about 120 to about 180.

In embodiments, the additive base oil has a kinematic viscosity at 100° C. of about 8 to about 18 $mm^2/s$, about 8 to about 17 $mm^2/s$, about 8 to about 16 $mm^2/s$, about 8 to about 15 $mm^2/s$, about 8 to about 14 $mm^2/s$, about 8 to about 13 $mm^2/s$, about 8 to about 12 $mm^2/s$, about 8 to about 11 $mm^2/s$, about 8 to about 10 $mm^2/s$, about 9 to about 20 $mm^2/s$, about 9 to about 18 $mm^2/s$, about 9 to about 17 $mm^2/s$, about 9 to about 16 $mm^2/s$, about 9 to about 15 $mm^2/s$, about 9 to about 14 $mm^2/s$, about 9 to about 13 $mm^2/s$, about 9 to about 12 $mm^2/s$, about 9 to about 11 $mm^2/s$, about 9 to about 10 $mm^2/s$, about 10 to about 20 $mm^2/s$, about 10 to about 18 $mm^2/s$, about 10 to about 17 $mm^2/s$, about 10 to about 16 $mm^2/s$, about 10 to about 15 $mm^2/s$, about 10 to about 14 $mm^2/s$, about 10 to about 13 $mm^2/s$, about 10 to about 12 $mm^2/s$, about 10 to about 11 $mm^2/s$, about 11 to about 20 $mm^2/s$, about 11 to about 18 $mm^2/s$, about 11 to about 17 $mm^2/s$, about 11 to about 16 $mm^2/s$, about 11 to about 15 $mm^2/s$, about 11 to about 14 $mm^2/s$, about 11 to about 13 $mm^2/s$, about 11 to about 12 $mm^2/s$, about 12 to about 20 $mm^2/s$, about 12 to about 18 $mm^2/s$, about 12 to about 17 $mm^2/s$, about 12 to about 16 $mm^2/s$, about 12 to about 15 $mm^2/s$, about 12 to about 14 $mm^2/s$, about 12 to about 13 $mm^2/s$, about 13 to about 20 $mm^2/s$, about 13 to about 18 $mm^2/s$, about 13 to about 17 $mm^2/s$, about 13 to about 16 $mm^2/s$, about 13 to about 15 $mm^2/s$, about 13 to about 14 $mm^2/s$, about 14 to about 20 $mm^2/s$, about 14 to about 18 $mm^2/s$, about 14 to about 17 $mm^2/s$, about 14 to about 16 $mm^2/s$, about 14 to about 15 $mm^2/s$, about 15 to about 20 $mm^2/s$, about 15 to about 18 $mm^2/s$, about 15 to about 17 $mm^2/s$, about 15 to about 16 $mm^2/s$, about 16 to about 20 $mm^2/s$, about 16 to about 18 $mm^2/s$, about 16 to about 17 $mm^2/s$, or more than 20 $mm^2/s$.

In embodiments, the additive base oil has an evaporated quantity by the NOACK volatility test of about 20 wt % or less, about 19 wt % or less, about 18 wt % or less, about 17 wt % or less, about 16 wt % or less, about 15 wt % or less, about 14 wt % or less, about 13 wt % or less, about 12 wt % or less, about 11 wt % or less, about 10 wt % or less, about 9 wt % or less, about 8 wt % or less, about 7 wt % or less, or about 6 wt % or less. In embodiments, the additive base oil has an evaporated quantity by the NOACK volatility test of about 20 wt %, about 19 wt %, about 18 wt %, about 17 wt %, about 16 wt %, about 15 wt %, about 14 wt %, about 13 wt %, about 12 wt %, about 11 wt %, about 10 wt %, about 9 wt %, about 8 wt %, about 7 wt %, or about 6 wt %.

In embodiments, the additive base oil can be characterized by: a) having a viscosity index of between about 80 and about 180; b) a kinematic viscosity of between about 8 and about 20 $mm^2/s$ at 100° C.; c) an evaporated quantity of about 15 wt % or less by the NOACK volatility test, or any combinations thereof. In embodiments, the additive base oil can be characterized by a) having a viscosity index of between about 120 and about 180; b) a kinematic viscosity of between about 9 and about 17 $mm^2/s$ at 100° C.; c) an evaporated quantity by the NOACK volatility test of about 15 wt % or less, or any combinations thereof.

Chlorinated Paraffins

The lubricant additive compositions provided herein comprise chlorinated paraffins. The term "chlorinated paraffin" or "CP" refers to chlorinated straight-chain hydrocarbons, which typically are mixtures. Chlorinated paraffin can be classified according to the carbon-chain length and percentage of chlorination, with carbon-chain lengths generally ranging from $C_{10}$ to $C_{30}$ and chlorination from about 35% to greater than about 70% by weight. The three most common commercial chlorinated paraffins are: short-chain, medium-chain and long-chain chlorinated paraffins. Short-chain chlorinated paraffin (SCCP) includes CPs that have a carbon-chain length of $C_{10-13}$. Medium-chain chlorinated paraffin (MCCP) includes CPs that have a carbon-chain length of $C_{13-20}$. Non-limiting, exemplary medium-chain chlorinated paraffin can have a carbon-chain length of $C_{13}$ to $C_{17}$, $C_{14}$ to $C_{17}$, $C_{14}$ to $C_{19}$, or $C_{14}$ to $C_{20}$. Long-chain chlorinated paraffin (LCCP) includes CPs that have a carbon-chain length of $C_{17-30}$. Non-limiting, exemplary long-chain chlorinated paraffin can have a carbon-chain length of $C_{17}$ to $C_{30}$, $C_{18}$ to $C_{30}$, or $C_{20}$ to $C_{30}$. Commercially available CP includes, without limitation, CP-50, CP-52, CP-56, CP-60, CP-63, and CP-70, etc.

Suitable CPs for use in the lubricant additive composition of the invention include CPs with carbon-chain lengths from $C_{10}$ to $C_{30}$ and percentage of chlorination from about 35% to greater than about 70% by weight. In any embodiments described herein, the CP can have any carbon-chain lengths that fall within $C_{10}$ to $C_{30}$ (e.g., $C_{10}$ to $C_{13}$, $C_{13}$ to $C_{17}$, $C_{14}$ to $C_{17}$, $C_{14}$ to $C_{19}$, $C_{17}$ to $C_{30}$, $C_{18}$ to $C_{30}$, or $C_{20}$ to $C_{30}$ etc.). In embodiments, the CP is a short-chain CP, a medium-chain CP, a long-chain CP, or a mixture thereof. In embodiments, the CP is a short-chain CP. In embodiments, the CP is a medium-chain CP. In embodiments, the CP is a long-chain CP. In embodiments, the CP has a carbon-chain lengths of $C_{10}$ to $C_{13}$, $C_{14}$ to $C_{17}$, $C_{14}$ to $C_{17}$, $C_{14}$ to $C_{19}$, $C_{17}$ to $C_{30}$, $C_{18}$ to $C_{30}$, or $C_{20}$ to $C_{30}$. In embodiments, the CP is a short-chain CP with a carbon-chain length of $C_{10}$ to $C_{13}$. In embodiments, the CP is a medium-chain CP with a carbon-chain length of $C_{14}$ to $C_{17}$. In embodiments, the CP is a long-chain CP with a carbon-chain length of $C_{17}$ to $C_{30}$, $C_{18}$ to $C_{30}$, or $C_{20}$ to $C_{30}$.

Suitable CP for use in the lubricant additive composition of the invention can have a percentage of chlorination from about 35% to greater than about 70% by weight. In any of the embodiments described herein, the CP has a percentage of chlorination of about 40 to about 70%, about 40 to about 49%, about 50 to about 59%, about 60 to about 69%, or more than about 70% by weight. In any of the embodiments described herein, the CP can have a percentage of chlorination of about 50%, about 52%, about 54%, about 56%, about 58%, about 60%, about 62%, about 63%, about 65%, about 67%, about 70%, or about 72% by weight. In embodiments, the CP has a percentage of chlorination of about 50%, about 52%, about 56%, about 60%, about 63%, or about 70% by weight.

Antioxidants

Antioxidants can achieve a stable lubricant additive composition. In any of the embodiments described herein, the lubricant additive composition comprises one or more antioxidant(s) (e.g., a first antioxidant, a second antioxidant, or both) that can improve stability of the lubricant additive composition against oxidative degradation, i.e., with improved oxidative stability.

Various antioxidants are known in the art. Suitable antioxidants for use in the lubricant additive composition of the invention include antioxidants (e.g., those known in the art) that can improve oxidative stability of the lubricant additive composition. Thus, exemplary antioxidants include the antioxidants that are disclosed in U.S. Pat. Nos. 6,750,184, 7,538,076, and 7,928,045, which are each herein incorporated by reference in their entirety. Suitable antioxidants for use in the lubricant additive composition of the invention include various amine antioxidants, phenol antioxidants, phosphite antioxidants, ascorbic acid, and tocopherols etc. In embodiments, antioxidants suitable for the lubricant additive compositions of the invention include amine antioxidants and phenol antioxidants.

In embodiments, the lubricant additive composition comprises a first antioxidant, wherein the first antioxidant is an amine antioxidant or a phenol antioxidant.

In embodiments, the first antioxidant is an amine antioxidant. In embodiments, the first antioxidant is an aliphatic amine or an aromatic amine. In embodiments, the first antioxidant is an aromatic amine. Aromatic amines known in the art are compounds that have an amino group, including both free amino (i.e., $NH_2$) and substituted amino group (e.g., $NR^1R^2$, wherein $R^1$ and $R^2$ are independently hydrogen, alkyl, arylalkyl, heteroarylalkyl, cyclo alkyl alkyl, heterocycloalkylalkyl, arylcycloalkylalkyl, heteroarylcycloalkylalkyl, arylheterocycloalkylalkyl, heteroarylheterocycloalkylalkyl, cycloalkyl, arylcycloalkyl, heteroarylcycloalkyl, heterocycloalkyl, arylheterocycloalkyl, heteroarylheterocycloalkyl, alkenyl, arylalkenyl, cycloalkenyl, arylcycloalkenyl, heteroarylcycloalkenyl, heterocycloalkenyl, arylheterocycloalkenyl, heteroarylheterocycloalkenyl, alkynyl, arylalkynyl, aryl, cycloalkylaryl, heterocycloalkylaryl, cycloalkenylaryl, heterocycloalkenylaryl, heteroaryl, cycloalkylheteroaryl, heterocycloalkylheteroaryl, cycloalkenylheteroaryl, or heterocycloalkenylheteroaryl), directly attached to an aromatic ring, such as a monocyclic aromatic ring (e.g., a phenyl ring, or a monocyclic heteraromatic ring such as a thiophene ring, a pyridine ring, a pyrimidine ring, a furan ring, a pyrazine ring, a pyridazine ring, or a triazine ring, etc.) or a polycyclic aromatic ring (e.g., a bicyclic aromatic ring such as a naphthalene ring, or a bicyclic heteroaromatic ring such as an indole ring, a benzofuran ring, a benzoimidazole ring, or a benzothiophene ring etc., or a tricyclic aromatic ring such as a carbazole).

In embodiments, the first antioxidant is an aromatic amine, wherein the amino group is attached to two aromatic rings, such as two monocyclic aromatic rings (e.g., as described herein) that are the same or different, two polycyclic aromatic rings (e.g., as described herein) that are the same or different, or one monocyclic aromatic ring (e.g., as described herein) and one polycyclic aromatic ring (e.g., as described herein). In embodiments, the first antioxidant is a diphenyl amine. In embodiments, the first antioxidant is an aromatic amine having the amino group attached to one monocyclic aromatic ring (e.g., a phenyl ring) and one polycyclic aromatic ring (e.g., a naphthalene ring). In embodiments, the first antioxidant is selected from the group consisting of N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N' dicyclohexyl-p-phenylenediamine, N,N'-diphenyl-p-phenylenediamine, N,N'-di(naphth-2-yl)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfonamido)-diphenylamine, N,N'-dimethyl-N,N'-di-sec-butyl-p-phenylenediamine, diphenylamine, styrenated diphenyl amine (CAS No. 68442-68-2), N-allyldiphenylamine, 4-isopropoxydiphenylamine, di(4-methoxyphenyl)amine, 2,4'-diaminodiphenylmethane, 4,4'-diaminodiphenylmethane, N,N,N',N'-tetramethyl-4,4'-diaminodiphenylmethane, 1,2-di[(2-methylphenyl)amino]-ethane, 1,2-di(phenylamino)propane, (o-tolyl)biguanide, di[4-(1',3'-dimethylbutyl)phenyl]amine, tert-octylated N-phenyl-1-naphthylamine, phenyl-1-naphthylamine p,p'-dioctyldiphenyl amine, mixture of mono- and di-alkylated tert-butyl/tert-octyl-diphenylamines, mixture of mono- and di-alkylated nonyldiphenylamines, mixture of mono- and di-alkylated dodecyldiphenylamines, mixture of mono- and di-alkylated isopropyl/isohexyl-diphenylamines, mixtures of mono- and di-alkylated tert-butyldiphenylamines, 2,3-dihydro-3,3-dimethyl-4H-1,4-benzothiazine, phenothiazine, mixture of mono- and di-alkylated tert-butyl/tert-octyl-phenothiazines, mixtures of mono- and di-alkylated tert-octylphenothiazines, N-allylphenothiazine, and N,N,N',N'-tetraphenyl-1,4-diaminobut-2-ene.

In embodiments, the first antioxidant is a phenol antioxidant. Phenol antioxidants are known in the art and encompass any phenolic compound, i.e., having a free OH group attached to a phenyl ring. As used herein, the term "phenolic compounds" also include compounds where the OH is attached to a phenyl ring, wherein the phenyl ring is part of a fused ring structure, e.g., the phenyl ring is part of a benzothiophene ring, a naphthalene ring, an indole ring, an benzofuran ring, or the like. Preferred phenolic antioxidants are hindered phenols (e.g., with at least one of the two ortho-positions of the phenolic OH substituted, e.g., with an alkyl group such as a methyl, ethyl, propyl, cyclopropyl, isopropyl, butyl, isobutyl, or tert-butyl group) or dimeric phenols.

Thus, in embodiments, the first antioxidant is a hindered phenol. In embodiments, the hindered phenol is selected from the group consisting of 2,6-di-tert-butyl-4-methylphenol, 2-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, 2,6-dinonyl-4-methylphenol, 2,4-dimethyl-6-(1'-methyl-undec-1'-yl)-phenol, 2,4-dimethyl-6-(1'-methylheptadec-1'-yl)-phenol, 2,4-dimethyl-6-(1'-methyltridec-1'-yl)-phenol, 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonylphenol and mixtures thereof.

In embodiments, the first antioxidant is a dimeric phenol. In embodiments, the first antioxidant is dimeric hindered phenol. In embodiments, the first antioxidant is a dimeric phenol selected from the group consisting of 2,2'-methylene-bis(4-methyl-6-tert-butyl phenol), 2,2'-methylene-bis(4-ethyl-6-tert-butyl phenol), 2,2'-methylene-bis[4-methyl-6-(α-methylcyclohexyl)phenol], 2,2'-methylene-bis(4-methyl-6-cyclohexylphenol), 2,2'-methylene-bis(6-nonyl-4-methylphenol), 2,2'-methylene-bis(4,6-di-tert-butylphenol), 2,2'-ethylidene-bis(4,6-di-tert-butylphenol), 2,2'-ethylidene-bis(6-tert-butyl-4-isobutylphenol), 2,2'-methylene-bis[6-(α-methylbenzyl)-4-nonylphenol], 2,2'-methylene-bis[6-(α,α-dimethyl-benzyl)-4-nonylphenol], 4,4'-methylene-bis(2,6-di-tert-butylphenol), 4,4'-methylene-bis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methylphenyl)-3-n-dodecylmercaptobutane, ethylene glycol bis[3,3-bis(3'-tert-butyl-4'-hydroxyphenyl)-butyrate], bis(3-tert-butyl-4-hydroxy-5-methylphenyl)dicyclopentadiene, bis[2-(3'-tert-butyl-2'-hydroxy-5'-methylbenzyl)-6-tert-butyl-4-methylphenyl]terephthalate, 1,1-bis(3,5-dimethyl-2-hydroxyphenyl)butane, 2,2-bis(3,5-di-tert-butyl-4-hydroxyphenyl)-propane, 2,2-bis(5-tert-butyl-4-hydroxy-2-methylphenyl)-4-n-dodecylmercaptobutane, 1,1,5,5-tetra(5-tert-butyl-4-hydroxy-2-methylphenyl)pentane.

The inventors have discovered that a lubricant additive composition of Formulation A containing an additive base oil, chlorinated paraffin, and a first antioxidant, is superior to conventional lubricant compositions. Non-limiting examples of Formulation A are shown in Tables 1a-d.

TABLE 1a

Examples of Formulation A[1]

| Examples | Base Oil (wt %) | Chlorinated Paraffin[2] (wt %) | Antioxidant (wt %) |
|---|---|---|---|
| 1-1a | Group III (77.3%) | SCCP (20%) | Aromatic amine (0.5%) |
| 1-2a | Group III (75.3%) | SCCP (22%) | Aromatic amine (0.5%) |
| 1-3a | Group III (77.3%) | MCCP (20%) | Aromatic amine (0.5%) |
| 1-4a | Group III (75.3%) | MCCP (22%) | Aromatic amine (0.5%) |
| 1-5a | Group III (77.3%) | LCCP (20%) | Aromatic amine (0.5%) |
| 1-6a | Group III (75.3%) | LCCP (22%) | Aromatic amine (0.5%) |

[1]The remaining mass are minor components, which can include, but are not limited to, an antifoaming agent (500 ppm), an anti-wear agent (2%), and a pour point depressant (0.2%).
[2]The CP in Formulation A has a percentage of chlorination of between 60 to 72% by weight.

TABLE 1b

Examples of Formulation A[1]

| Examples | Base Oil (wt %) | Chlorinated Paraffin[2] (wt %) | Antioxidant (wt %) |
|---|---|---|---|
| 1-1b | Group II (10-80%) | SCCP (10-60%) | amine or phenol (0.01-5%) |
| 1-2b | Group III (10-80%) | SCCP (10-60%) | amine or phenol (0.01-5%) |
| 1-3b | Group IV (10-80%) | SCCP (10-60%) | amine or phenol (0.01-5%) |
| 1-4b | Synthetic Ester (10-80%) | SCCP (10-60%) | amine or phenol (0.01-5%) |
| 1-5b | Group II (10-80%) | SCCP (15-45%) | amine or phenol (0.01-5%) |
| 1-6b | Group III (10-80%) | SCCP (15-45%) | amine or phenol (0.01-5%) |
| 1-7b | Group IV (10-80%) | SCCP (15-45%) | amine or phenol (0.01-5%) |
| 1-8b | Synthetic Ester (10-80%) | SCCP (15-45%) | amine or phenol (0.01-5%) |
| 1-9b | Group II (20-60%) | SCCP (15-45%) | amine or phenol (0.01-5%) |
| 1-10b | Group III (20-60%) | SCCP (15-45%) | amine or phenol (0.01-5%) |
| 1-11b | Group IV (20-60%) | SCCP (15-45%) | amine or phenol (0.01-5%) |
| 1-12b | Synthetic Ester (20-60%) | SCCP (15-45%) | amine or phenol (0.01-5%) |
| 1-13b | Group III (20-60%) | SCCP (15-45%) | aromatic amine (0.1-2%) |
| 1-14b | Group III (20-60%) | SCCP (15-45%) | hindered phenol (0.1-2%) |
| 1-15b | Group IV (20-60%) | SCCP (15-45%) | aromatic amine (0.1-2%) |
| 1-16b | Group IV (20-60%) | SCCP (15-45%) | hindered phenol (0.1-2%) |

TABLE 1b-continued

Examples of Formulation A[1]

| Examples | Base Oil (wt %) | Chlorinated Paraffin[2] (wt %) | Antioxidant (wt %) |
|---|---|---|---|
| 1-17b | polyester (20-60%) | SCCP (15-45%) | aromatic amine (0.1-2%) |
| 1-18b | polyester (20-60%) | SCCP (15-45%) | hindered phenol (0.1-2%) |

[1]The remaining mass are minor components, which can include, but are not limited to, an antifoaming agent (500 ppm), an anti-wear agent, and a pour point depressant.
[2]The CP in Formulation A has a percentage of chlorination of between 40 to 72% by weight.

TABLE 1c

Examples of Formulation A[1]

| Examples | Base Oil (wt %) | Chlorinated Paraffin[2] (wt %) | Antioxidant (wt %) |
|---|---|---|---|
| 1-1c | Group II (10-80%) | MCCP (10-60%) | amine or phenol (0.01-5%) |
| 1-2c | Group III (10-80%) | MCCP (10-60%) | amine or phenol (0.01-5%) |
| 1-3c | Group IV (10-80%) | MCCP (10-60%) | amine or phenol (0.01-5%) |
| 1-4c | Synthetic Ester (10-80%) | MCCP (10-60%) | amine or phenol (0.01-5%) |
| 1-5c | Group II (10-80%) | MCCP (15-45%) | amine or phenol (0.01-5%) |
| 1-6c | Group III (10-80%) | MCCP (15-45%) | amine or phenol (0.01-5%) |
| 1-7c | Group IV (10-80%) | MCCP (15-45%) | amine or phenol (0.01-5%) |
| 1-8c | Synthetic Ester (10-80%) | MCCP (15-45%) | amine or phenol (0.01-5%) |
| 1-9c | Group II (20-60%) | MCCP (15-45%) | amine or phenol (0.01-5%) |
| 1-10c | Group III (20-60%) | MCCP (15-45%) | amine or phenol (0.01-5%) |
| 1-11c | Group IV (20-60%) | MCCP (15-45%) | amine or phenol (0.01-5%) |
| 1-12c | Synthetic Ester (20-60%) | MCCP (15-45%) | amine or phenol (0.01-5%) |
| 1-13c | Group III (20-60%) | MCCP (15-45%) | aromatic amine (0.1-2%) |
| 1-14c | Group III (20-60%) | MCCP (15-45%) | hindered phenol (0.1-2%) |
| 1-15c | Group IV (20-60%) | MCCP (15-45%) | aromatic amine (0.1-2%) |
| 1-16c | Group IV (20-60%) | MCCP (15-45%) | hindered phenol (0.1-2%) |
| 1-17c | polyester (20-60%) | MCCP (15-45%) | aromatic amine (0.1-2%) |
| 1-18c | polyester (20-60%) | MCCP (15-45%) | hindered phenol (0.1-2%) |

[1]The remaining mass are minor components, which can include, but are not limited to, an antifoaming agent (500 ppm), an anti-wear agent, and a pour point depressant.
[2]The CP in Formulation A has a percentage of chlorination of between 40 to 72% by weight.

TABLE 1d

Examples of Formulation A[1]

| Examples | Base Oil (wt %) | Chlorinated Paraffin[2] (wt %) | Antioxidant (wt %) |
|---|---|---|---|
| 1-1d | Group II (10-80%) | LCCP (10-60%) | amine or phenol (0.01-5%) |
| 1-2d | Group III (10-80%) | LCCP (10-60%) | amine or phenol (0.01-5%) |
| 1-3d | Group IV (10-80%) | LCCP (10-60%) | amine or phenol (0.01-5%) |
| 1-4d | Synthetic Ester (10-80%) | LCCP (10-60%) | amine or phenol (0.01-5%) |

TABLE 1d-continued

| Examples of Formulation A[1] | | | |
|---|---|---|---|
| Examples | Base Oil (wt %) | Chlorinated Paraffin[2] (wt %) | Antioxidant (wt %) |
| 1-5d | Group II (10-80%) | LCCP (15-45%) | amine or phenol (0.01-5%) |
| 1-6d | Group III (10-80%) | LCCP (15-45%) | amine or phenol (0.01-5%) |
| 1-7d | Group IV (10-80%) | LCCP (15-45%) | amine or phenol (0.01-5%) |
| 1-8d | Synthetic Ester (10-80%) | LCCP (15-45%) | amine or phenol (0.01-5%) |
| 1-9d | Group II (20-60%) | LCCP (15-45%) | amine or phenol (0.01-5%) |
| 1-10d | Group III (20-60%) | LCCP (15-45%) | amine or phenol (0.01-5%) |
| 1-11d | Group IV (20-60%) | LCCP (15-45%) | amine or phenol (0.01-5%) |
| 1-12d | Synthetic Ester (20-60%) | LCCP (15-45%) | amine or phenol (0.01-5%) |
| 1-13d | Group III (20-60%) | LCCP (15-45%) | aromatic amine (0.1-2%) |
| 1-14d | Group III (20-60%) | LCCP (15-45%) | hindered phenol (0.1-2%) |
| 1-15d | Group IV (20-60%) | LCCP (15-45%) | aromatic amine (0.1-2%) |
| 1-16d | Group IV (20-60%) | LCCP (15-45%) | hindered phenol (0.1-2%) |
| 1-17d | polyester (20-60%) | LCCP (15-45%) | aromatic amine (0.1-2%) |
| 1-18d | polyester (20-60%) | LCCP (15-45%) | hindered phenol (0.1-2%) |

[1]The remaining mass are minor components, which can include, but are not limited to, an antifoaming agent (500 ppm), an anti-wear agent, and a pour point depressant.
[2]The CP in Formulation A has a percentage of chlorination of between 40 to 72% by weight.

Formulation B: Additive Base Oil, Chlorinated Paraffin, and Two Antioxidants

The present inventor have also discovered that for some applications, it is advantageous to include two antioxidants in the lubricant additive composition.

Thus, in any of the embodiments disclosed herein, the lubricant additive composition has a second antioxidant. In embodiments, the second antioxidant is in an amount of about 0.01% to about 5%, about 0.01% to about 4%, about 0.01% to about 3%, about 0.01% to about 2%, about 0.01% to about 1%, about 0.1% to about 5%, about 0.1% to about 4%, about 0.1% to about 3%, about 0.1% to about 2%, about 0.1% to about 1%, about 0.5% to about 5%, about 0.5% to about 4%, about 0.5% to about 3%, about 0.5% to about 2%, about 0.5% to about 1%, or more than about 5% by weight of the lubricant additive composition. In any embodiments described herein, the second antioxidant can also be in an amount of about 0.01%, about 0.05%, about 0.1%, about 0.2%, about 0.3%, about 0.4%, about 0.5%, about 0.6%, about 0.7%, about 0.8%, about 0.9%, about 1%, about 2%, about 3%, about 4%, or about 5% by weight of the lubricant additive composition.

In embodiments, the invention provides a lubricant additive composition comprising a) an additive base oil in an amount of 10-80% by weight of the additive composition; b) a chlorinated paraffin in an amount of 10-60% by weight of the additive composition; c) a first antioxidant in an amount of 0.01-5% by weight of the additive composition; and d) a second antioxidant in an amount of 0.01-5% by weight of the additive composition. In embodiments, the chlorinated paraffin is in an amount of about 15% to about 45% by weight of the additive composition. Suitable additive base oil, chlorinated paraffin, first antioxidant, and second antioxidant are described herein.

Suitable second antioxidants for use in the lubricant additive composition of the invention include any antioxidant that is suitable for use as the first antioxidant as described herein (e.g., as described in paragraphs [0041] to [0047] of the present disclosure). In embodiments, the first antioxidant and the second antioxidant function differently. For example, in embodiments, the first antioxidant is more effective in protecting the lubricant additive composition against oxidative degradation at lower temperature (e.g., at room temperature), whereas the second antioxidant is more effective in protecting the lubricant additive composition against oxidative degradation at higher temperature (e.g., at above 100° C., above 200° C., above 300° C., above 400° C., above 500° C. etc.).

Therefore, in any of the embodiments disclosed herein, the second antioxidant can be the same type or a different type of antioxidant as the first antioxidant. Preferably, the second antioxidant is an amine antioxidant or a phenol antioxidant. In especially embodiments, the first antioxidant is an amine antioxidant and the second antioxidant is a phenol antioxidant, or vice versa.

The present inventors have also discovered that in embodiments where the lubricant additive composition comprising both a first antioxidant and a second antioxidant, the weight ratio of the first antioxidant and the second antioxidant can influence the overall stability of the lubricant additive composition. The present inventors have also discovered that for the present invention, the weight ratio of the first antioxidant and the second antioxidant can be from about 1:500 to about 500:1.

Thus, in any of the embodiments described herein, the lubricant additive composition comprises a weight ratio of the first antioxidant to the second antioxidant of about 1:500 to about 500:1, about 1:250 to about 250:1, about 1:200 to about 200:1, about 1:150 to about 150:1, about 1:100 to about 100:1, about 1:50 to about 50:1, about 1:25 to about 25:1, about 1:10 to about 10:1, about 1:5 to about 5:1, about 1:3 to about 3:1, about 1:2 to about 2:1, or about 1:1. In embodiments wherein the lubricant additive composition comprises both an amine antioxidant and a phenol antioxidant, a weight ratio of the phenol antioxidant to the amine antioxidant can be about 1:500 to about 500:1, about 1:250 to about 250:1, about 1:200 to about 200:1, about 1:150 to about 150:1, about 1:100 to about 100:1, about 1:50 to about 50:1, about 1:25 to about 25:1, about 1:10 to about 10:1, about 1:5 to about 5:1, about 1:3 to about 3:1, about 1:2 to about 2:1, or about 1:1. In embodiments, the weight ratio of the phenol antioxidant to the amine antioxidant is about 1:1 to about 50:1, or about 15:1 to about 25:1.

Non-limiting examples of Formulation B are shown in Tables 2a-2d. For illustration purposes, Tables 2a-2d only includes Examples with additive base oil being a mixture of a Group III and a Group IV base oil. However, other non-limiting additive base oils can also be used in any of the examples in Tables 2a-2d, e.g., a Group II, a Group III, a Group IV, a polyester, a mixture of a Group II and a Group IV, a mixture of a Group II and a polyester, a mixture of a Group III and a polyester, a mixture of a Group III, IV, and a polyester, or a mixture of a Group II, IV, and a polyester.

TABLE 2a

| Examples of Formulation B | | | | |
|---|---|---|---|---|
| Examples | Base Oil wt %[1] | Chlorinated Paraffin[2] (wt %) | First Antioxidant (wt %) | Second Antioxidant (wt %) |
| 2-1a | 86% | SCCP (10%) | Aromatic amine (0.1%) | Hindered phenol (0.5%) |
| 2-2a | 81% | SCCP (15%) | Aromatic amine (0.1%) | Hindered phenol (0.5%) |

TABLE 2a-continued

| Examples of Formulation B | | | | |
|---|---|---|---|---|
| Examples | Base Oil wt %[1] | Chlorinated Paraffin[2] (wt %) | First Antioxidant (wt %) | Second Antioxidant (wt %) |
| 2-3a | 76% | SCCP (20%) | Aromatic amine (0.1%) | Hindered phenol (0.5%) |
| 2-4a | 66% | SCCP (30%) | Aromatic amine (0.1%) | Hindered phenol (0.5%) |
| 2-5a | 81% | SCCP (15%) | Aromatic amine (0.1%) | Hindered phenol (1%) |
| 2-6a | 81% | SCCP (15%) | Aromatic amine (0.1%) | Hindered phenol (2%) |
| 2-7a | 76% | SCCP (20%) | Aromatic amine (0.1%) | Hindered phenol (1%) |
| 2-8a | 76% | SCCP (20%) | Aromatic amine (0.1%) | Hindered phenol (2%) |
| 2-9a | 66% | SCCP (30%) | Aromatic amine (0.5%) | Hindered phenol (0.5%) |
| 2-10a | 66% | SCCP (30%) | Aromatic amine (0.5%) | Hindered phenol (2%) |
| 2-11a | 76% | MCCP (20%) | Aromatic amine (0.1%) | Hindered phenol (2%) |
| 2-12a | 66% | LCCP (30%) | Aromatic amine (0.5%) | Hindered phenol (2%) |

[1]The remaining mass are minor components, which can include, but are not limited to an antifoaming agent (e.g., 500 ppm) and pour point depressant (e.g., 0.2%).
[2]The CP in Formulation B has a percentage of chlorination of between 60 to 72% by weight.

TABLE 2b

| Examples of Formulation B[1] | | | | |
|---|---|---|---|---|
| Examples | Base Oil (wt %) | Chlorinated Paraffin[2] (wt %) | First Antioxidant (wt %) | Second Antioxidant (wt %) |
| 2-1b | 10-80% | SCCP (10-60%) | Aromatic amine (0.01-5%) | Hindered phenol (0.01-5%) |
| 2-2b | 10-80% | SCCP (15-45%) | Aromatic amine (0.01-5%) | Hindered phenol (0.01-5%) |
| 2-3b | 10-80% | SCCP (20-40%) | Aromatic amine (0.01-5%) | Hindered phenol (0.01-5%) |
| 2-4b | 20-60% | SCCP (15-45%) | Aromatic amine (0.1-1%) | Hindered phenol (0.5-3%) |
| 2-5b | 20-60% | SCCP (15-45%) | Aromatic amine (0.1-1%) | Hindered phenol (0.5-3%) |
| 2-6b | 20-60% | SCCP (15-45%) | Aromatic amine (0.1-1%) | Hindered phenol (1-3%) |
| 2-7b | 20-60% | SCCP (15-45%) | Aromatic amine (0.1-0.5%) | Hindered phenol (1-3%) |
| 2-8b | 30-70% | SCCP (15-45%) | Aromatic amine (0.1-5%) | Hindered phenol (0.1-5%) |
| 2-9b | 30-70% | SCCP (15-45%) | Aromatic amine (0.1-1%) | Hindered phenol (0.5-3%) |
| 2-10b | 30-70% | SCCP (15-45%) | Aromatic amine (0.1-1%) | Hindered phenol (0.5-3%) |
| 2-11b | 30-70% | SCCP (15-45%) | Aromatic amine (0.1-1%) | Hindered phenol (1-3%) |
| 2-12b | 30-70% | SCCP (15-45%) | Aromatic amine (0.1-0.5%) | Hindered phenol (1-3%) |
| 2-13b | 30-70% | SCCP (20-40%) | Aromatic amine (0.1-5%) | Hindered phenol (0.1-5%) |
| 2-14b | 30-70% | SCCP (20-40%) | Aromatic amine (0.1-1%) | Hindered phenol (0.5-3%) |
| 2-15b | 30-70% | SCCP (20-40%) | Aromatic amine (0.1-1%) | Hindered phenol (0.5-3%) |
| 2-16b | 30-70% | SCCP (20-40%) | Aromatic amine (0.1-1%) | Hindered phenol (1-3%) |
| 2-17b | 30-70% | SCCP (20-40%) | Aromatic amine (0.1-0.5%) | Hindered phenol (1-3%) |

[1]The remaining mass are minor components, which can include, but are not limited to an antifoaming agent (e.g., 500 ppm) and pour point depressant (e.g., 0.2%).
[2]The CP in Formulation B has a percentage of chlorination of between 40 to 72% by weight.

TABLE 2c

| Examples of Formulation B[1] | | | | |
|---|---|---|---|---|
| Examples | Base Oil (wt %) | Chlorinated Paraffin[2] (wt %) | First Antioxidant (wt %) | Second Antioxidant (wt %) |
| 2-1c | 10-80% | MCCP (10-60%) | Aromatic amine (0.01-5%) | Hindered phenol (0.01-5%) |
| 2-2c | 10-80% | MCCP (15-45%) | Aromatic amine (0.01-5%) | Hindered phenol (0.01-5%) |
| 2-3c | 10-80% | MCCP (20-40%) | Aromatic amine (0.01-5%) | Hindered phenol (0.01-5%) |
| 2-4c | 20-60% | MCCP (15-45%) | Aromatic amine (0.1-1%) | Hindered phenol (0.5-3%) |
| 2-5c | 20-60% | MCCP (15-45%) | Aromatic amine (0.1-1%) | Hindered phenol (0.5-3%) |
| 2-6c | 20-60% | MCCP (15-45%) | Aromatic amine (0.1-1%) | Hindered phenol (1-3%) |
| 2-7c | 20-60% | MCCP (15-45%) | Aromatic amine (0.1-0.5%) | Hindered phenol (1-3%) |
| 2-8c | 30-70% | MCCP (15-45%) | Aromatic amine (0.1-5%) | Hindered phenol (0.1-5%) |
| 2-9c | 30-70% | MCCP (15-45%) | Aromatic amine (0.1-1%) | Hindered phenol (0.5-3%) |
| 2-10c | 30-70% | MCCP (15-45%) | Aromatic amine (0.1-1%) | Hindered phenol (0.5-3%) |
| 2-11c | 30-70% | MCCP (15-45%) | Aromatic amine (0.1-1%) | Hindered phenol (1-3%) |
| 2-12c | 30-70% | MCCP (15-45%) | Aromatic amine (0.1-0.5%) | Hindered phenol (1-3%) |
| 2-13c | 30-70% | MCCP (20-40%) | Aromatic amine (0.1-5%) | Hindered phenol (0.1-5%) |
| 2-14c | 30-70% | MCCP (20-40%) | Aromatic amine (0.1-1%) | Hindered phenol (0.5-3%) |
| 2-15c | 30-70% | MCCP (20-40%) | Aromatic amine (0.1-1%) | Hindered phenol (0.5-3%) |
| 2-16c | 30-70% | MCCP (20-40%) | Aromatic amine (0.1-1%) | Hindered phenol (1-3%) |
| 2-17c | 30-70% | MCCP (20-40%) | Aromatic amine (0.1-0.5%) | Hindered phenol (1-3%) |

[1]The remaining mass are minor components, which can include, but are not limited to an antifoaming agent (e.g., 500 ppm) and pour point depressant (e.g., 0.2%).
[2]The CP in Formulation B has a percentage of chlorination of between 40 to 72% by weight.

TABLE 2d

| Examples of Formulation B[1] | | | | |
|---|---|---|---|---|
| Examples | Base Oil (wt %) | Chlorinated Paraffin[2] (wt %) | First Antioxidant (wt %) | Second Antioxidant (wt %) |
| 2-1d | 10-80% | LCCP (10-60%) | Aromatic amine (0.01-5%) | Hindered phenol (0.01-5%) |
| 2-2d | 10-80% | LCCP (15-45%) | Aromatic amine (0.01-5%) | Hindered phenol (0.01-5%) |
| 2-3d | 10-80% | LCCP (20-40%) | Aromatic amine (0.01-5%) | Hindered phenol (0.01-5%) |
| 2-4d | 20-60% | LCCP (15-45%) | Aromatic amine (0.1-1%) | Hindered phenol (0.5-3%) |
| 2-5d | 20-60% | LCCP (15-45%) | Aromatic amine (0.1-1%) | Hindered phenol (0.5-3%) |
| 2-6d | 20-60% | LCCP (15-45%) | Aromatic amine (0.1-1%) | Hindered phenol (1-3%) |
| 2-7d | 20-60% | LCCP (15-45%) | Aromatic amine (0.1-0.5%) | Hindered phenol (1-3%) |
| 2-8d | 30-70% | LCCP (15-45%) | Aromatic amine (0.1-5%) | Hindered phenol (0.1-5%) |
| 2-9d | 30-70% | LCCP (15-45%) | Aromatic amine (0.1-1%) | Hindered phenol (0.5-3%) |
| 2-10d | 30-70% | LCCP (15-45%) | Aromatic amine (0.1-1%) | Hindered phenol (0.5-3%) |
| 2-11d | 30-70% | LCCP (15-45%) | Aromatic amine (0.1-1%) | Hindered phenol (1-3%) |
| 2-12d | 30-70% | LCCP (15-45%) | Aromatic amine (0.1-0.5%) | Hindered phenol (1-3%) |

TABLE 2d-continued

| Examples of Formulation B[1] | | | | |
|---|---|---|---|---|
| Examples | Base Oil (wt %) | Chlorinated Paraffin[2] (wt %) | First Antioxidant (wt %) | Second Antioxidant (wt %) |
| 2-13d | 30-70% | LCCP (20-40%) | Aromatic amine (0.1-5%) | Hindered phenol (0.1-5%) |
| 2-14d | 30-70% | LCCP (20-40%) | Aromatic amine (0.1-1%) | Hindered phenol (0.5-3%) |
| 2-15d | 30-70% | LCCP (20-40%) | Aromatic amine (0.1-1%) | Hindered phenol (0.5-3%) |
| 2-16d | 30-70% | LCCP (20-40%) | Aromatic amine (0.1-1%) | Hindered phenol (1-3%) |
| 2-17d | 30-70% | LCCP (20-40%) | Aromatic amine (0.1-0.5%) | Hindered phenol (1-3%) |

[1]The remaining mass are minor components, which can include, but are not limited to an antifoaming agent (e.g., 500 ppm) and pour point depressant (e.g., 0.2%).
[2]The CP in Formulation B has a percentage of chlorination of between 40 to 72% by weight.

Formulation C: More than one Additive Base Oil, CP, and Antioxidant(s)

A given base oil can have its own unique properties. The inventors have also found that instead of using a single base oil as the additive base oil, it is advantageous in certain applications for the lubricant additive composition to include a mixture of base oils having different properties.

Thus, in embodiments, the invention also provides a lubricant additive composition comprising a chlorinated paraffin and at least two different kinds of additive base oil (e.g., a mixture of Group III and Group IV base oil, a mixture of a Group II and Group IV base oil, a mixture of a Group II and an ester base oil, a mixture of a Group III and an ester base oil, a mixture of Group IV and an ester base oil, a mixture of Group II, Group IV, and an ester base oil, or a Group III, Group IV, and an ester base oil). Suitable chlorinated paraffin and the weight percentage thereof are described herein, e.g., short-chained chlorinated paraffin, medium-chain chlorinated paraffin, or long-chain chlorinated paraffin. Suitable additive base oil and the weight percentage thereof are also described herein. In embodiments, the lubricant additive composition also comprises a first antioxidant (e.g., as described herein). In embodiments, the lubricant additive composition comprising a first antioxidant further comprises a second antioxidant, wherein suitable first antioxidants and second antioxidants, and the weight percentages thereof are described herein. In embodiments, the lubricant additive composition has at least one antioxidant.

In embodiments, the invention provides a lubricant additive composition comprising a) more than one (e.g., 2, 3, 4, 5, or 6) additive base oils independently in an amount of 10-80% by weight of the additive composition; and b) a chlorinated paraffin in an amount of 10-60% by weight of the additive composition. In embodiments, the lubricant additive composition also comprises a first antioxidant in an amount of 0.01-5% by weight of the additive composition. In embodiments, the chlorinated paraffin is in an amount of about 15% to about 45% by weight of the additive composition.

In embodiments, the lubricant additive composition comprises two or more different kinds of additive base oil, with one additive base oil in an amount of about 10% to about 80% by weight of the additive composition, and the other(s) additive base oil in an amount of about 1% to about 50% by weight of the additive composition. Other suitable weight percentages of the additive base oil are described herein.

In any of the embodiments described herein, the total weight percentages of the additive base oil can be about 10% to about 80%, about 10% to about 70%, about 10% to about 60%, about 10% to about 50%, about 10% to about 40%, about 10% to about 30%, about 10% to about 20%, about 20% to about 80%, about 20% to about 70%, about 20% to about 60%, about 20% to about 50%, about 20% to about 40%, about 20% to about 30%, about 30% to about 80%, about 30% to about 70%, about 30% to about 60%, about 30% to about 50%, about 30% to about 40%, about 40% to about 80%, about 40% to about 70%, about 40% to about 60%, about 40% to about 50%, about 50% to about 80%, about 50% to about 70%, about 50% to about 60%, about 60% to about 80%, about 60% to about 70%, about 70% to about 80%, or about 80% to about 90% of the lubricant additive composition. In any of the embodiments described herein, the total weight percentages of the additive base oil can also be in an amount of about 10%, about 20%, about 30%, about 40%, about 50%, about 60%, about 70%, about 80%, or about 90% by weight of the lubricant additive composition.

Various combinations of additive base oil can be used in the present invention. In embodiments, the lubricant additive composition comprises two different kinds of additive base oil, wherein one of the additive base oil is a Group I, Group II, Group II$^+$, Group III, Group III$^+$, or Group IV base oil, and the other of the additive base oil is a Group V base oil, such as a synthetic ester base oil (e.g., a polyester base oil, or other ester base oil described herein). In embodiments, the lubricant additive composition comprises two different kinds of additive base oils, wherein each of the two additive base oils is independently a Group I, Group II, Group II$^+$, Group III, Group III$^+$, Group IV or a Group V base oil. In embodiments, the lubricant additive composition comprises two different kinds of additive base oil, wherein one of the additive base oil is a Group I, Group II, Group II$^+$, Group III, Group III$^+$, or Group IV base oil, and the other of the additive base oil is a Group IV base oil, such as a low-viscosity PAO, a medium-viscosity PAO or a high-viscosity PAO. In embodiments, the lubricant additive composition comprises three different kinds of additive base oil, wherein two of the additive base oil is a Group I, Group II, Group II$^+$, Group III, Group III$^+$, or Group IV base oil, and the other of the additive base oil is a Group V base oil, such as a synthetic ester base oil (e.g., a polyester base oil, or other ester base oil described herein). In embodiments, the lubricant additive composition comprises three different kinds of additive base oil, wherein each of the three additive base oil is independently a Group I, Group II, Group II$^+$, Group III, Group III$^+$, Group IV or a Group V base oil. In embodiments, the lubricant additive composition comprises three different kinds of additive base oil, wherein two of the additive base oil is a Group I, Group II, Group II$^+$, Group III, Group III$^+$, or Group IV base oil, and the other of the additive base oil is a Group IV base oil, such as a low-viscosity PAO, a medium-viscosity PAO or a high-viscosity PAO. In embodiments, the lubricant additive composition comprises at least one additive base oil selected from the group consisting of Group III base oil, a Group IV base oil, and a polyester base oil. Other combinations of additive base oil (e.g., as described herein) can also be used in the present invention.

Non-limiting examples of lubricant additive composition of the present invention are shown in Tables 3 and 4a-d.

TABLE 3

| Examples of Formulation C | | | |
|---|---|---|---|
| Examples | Base Oil (wt %[1]) | Chlorinated Paraffin[2] (wt %) | Antioxidant (wt %) |
| 3-1 | Mix of Group III and Group IV (87.3%) | SCCP (10%) | Aromatic amine (0.5%) |
| 3-2 | Mix of Group III and Group IV (85.3%) | SCCP (12%) | Aromatic amine (0.5%) |
| 3-3 | Mix of Group III and Group IV (87.3%) | MCCP (10%) | Aromatic amine (0.5%) |
| 3-4 | Mix of Group III and Group IV (85.3%) | MCCP (12%) | Aromatic amine (0.5%) |
| 3-5 | Mix of Group III and Group IV (87.3%) | LCCP (10%) | Aromatic amine (0.5%) |
| 3-6 | Mix of Group III and Group IV (85.3%) | LCCP (12%) | Aromatic amine (0.5%) |

[1]The remaining mass are minor components, which can include, but are not limited to an antifoaming agent (500 ppm), an anti-wear agent (2%), and a pour point depressant (0.2%).
[2]The CP in Formulation C has a percentage of chlorination of between 60 to 72% by weight.

TABLE 4a

| Additional Examples of Formulation C | | | |
|---|---|---|---|
| Examples | Base Oil (wt %[1]) | Chlorinated Paraffin[2] (wt %) | Antioxidant (wt %) |
| 4-1a | Mix of Group III and polyester (89.7%) | SCCP (10%) | Aromatic amine (0.1%) |
| 4-2a | Mix of Group III and polyester (89.7%) | SCCP (10%) | Aromatic amine (0.1%) |
| 4-3a | Mix of Group III and polyester (84.7%) | SCCP (15%) | Aromatic amine (0.1%) |

TABLE 4a-continued

| Additional Examples of Formulation C | | | |
|---|---|---|---|
| Examples | Base Oil (wt %[1]) | Chlorinated Paraffin[2] (wt %) | Antioxidant (wt %) |
| 4-4a | Mix of Group III and polyester (89.7%) | SCCP (10%) | Aromatic amine (0.1%) |
| 4-5a | Mix of Group III and polyester (89.7%) | MCCP (10%) | Aromatic amine (0.1%) |
| 4-6a | Mix of Group III and polyester (89.7%) | MCCP (10%) | Aromatic amine (0.1%) |
| 4-7a | Mix of Group III and polyester (84.7%) | MCCP (15%) | Aromatic amine (0.1%) |
| 4-8a | Mix of Group III and polyester (89.7%) | MCCP (10%) | Aromatic amine (0.1%) |
| 4-9a | Mix of Group III and polyester (89.7%) | LCCP (10%) | Aromatic amine (0.1%) |
| 4-10a | Mix of Group III and polyester (89.7%) | LCCP (10%) | Aromatic amine (0.1%) |
| 4-11a | Mix of Group III and polyester (84.7%) | LCCP (15%) | Aromatic amine (0.1%) |
| 4-12a | Mix of Group III and polyester (89.7%) | LCCP (10%) | Aromatic amine (0.1%) |
| 4-13a | Mix of Group III, PAO and polyester (88.7%)[3] | SCCP (10%) | Aromatic amine (0.1%) |
| 4-14a | Mix of Group III, PAO and polyester (88.7%)[3] | MCCP (10%) | Aromatic amine (0.1%) |
| 4-15a | Mix of Group III, PAO and polyester (88.7%)[3] | LCCP (10%) | Aromatic amine (0.1%) |

[1]The remaining mass are minor components, which can include, but are not limited to, an antifoaming agent (500 ppm) and a pour point depressant (0.2%).
[2]The CP in Formulation C has percentage of chlorination of between 60 to 72% by weight.
[3]The remaining mass are minor components, which can include, but are not limited to, an antifoaming agent (500 ppm), an anti-wear agent (1%), and a pour point depressant (0.2%).

TABLE 4b

| Additional Examples of Formulation C | | | |
|---|---|---|---|
| Examples | Base Oil (wt %[1]) | Chlorinated Paraffin[2] (wt %) | Antioxidant (wt %) |
| 4-1b | Mix of Group III and Group IV (20-80%) | SCCP (10-60%) | amine or phenol (0.01-5%) |
| 4-2b | Mix of Group III and Group IV (20-60%) | SCCP (10-60%) | amine or phenol (0.01-5%) |
| 4-3b | Mix of Group III and Group IV (30-70%) | SCCP (10-60%) | amine or phenol (0.01-5%) |
| 4-4b | Mix of Group III and polyester (20-80%) | SCCP (10-60%) | amine or phenol (0.01-5%) |
| 4-5b | Mix of Group III and polyester (30-80%) | SCCP (10-60%) | amine or phenol (0.01-5%) |
| 4-6b | Mix of Group III and polyester (30-70%) | SCCP (10-60%) | amine or phenol (0.01-5%) |
| 4-7b | Mix of Group III and polyester (40-70%) | SCCP (10-60%) | amine or phenol (0.01-5%) |
| 4-8b | Mix of Group III and polyester (35-65%) | SCCP (10-60%) | amine or phenol (0.01-5%) |
| 4-9b | Mix of Group III, PAO and polyester (20-80%) | SCCP (10-60%) | amine or phenol (0.01-5%) |
| 4-10b | Mix of Group III, PAO and polyester (30-80%)[3] | SCCP (10-60%) | amine or phenol (0.01-5%) |
| 4-11b | Mix of Group III, PAO and polyester (30-75%) | SCCP (10-60%) | amine or phenol (0.01-5%) |
| 4-12b | Mix of Group III and polyester (35-70%) | SCCP (10-60%) | amine or phenol (0.01-5%) |
| 4-13b | Mix of Group III, PAO and polyester (35-65%) | SCCP (10-60%) | amine or phenol (0.01-5%) |
| 4-14b | Mix of Group III, PAO and polyester (20-80%) | SCCP (15-45%) | amine or phenol (0.1-5%) |
| 4-15b | Mix of Group III, PAO and polyester (30-80%)[3] | SCCP (15-45%) | amine or phenol (0.1-5%) |
| 4-16b | Mix of Group III, PAO and polyester (30-75%) | SCCP (15-45%) | amine or phenol (0.1-5%) |

TABLE 4b-continued

| Additional Examples of Formulation C | | | |
|---|---|---|---|
| Examples | Base Oil (wt %[1]) | Chlorinated Paraffin[2] (wt %) | Antioxidant (wt %) |
| 4-17b | Mix of Group III and polyester (35-70%) | SCCP (15-45%) | amine or phenol (0.1-5%) |
| 4-18b | Mix of Group III, PAO and polyester (35-65%) | SCCP (15-45%) | amine or phenol (0.1-5%) |

[1]The remaining mass are minor components, which can include, but are not limited to, an antifoaming agent (500 ppm) and a pour point depressant (0.2%).
[2]The CP in Formulation C has percentage of chlorination of between 40 to 72% by weight.

TABLE 4c

| Additional Examples of Formulation C | | | |
|---|---|---|---|
| Examples | Base Oil (wt %[1]) | Chlorinated Paraffin[2] (wt %) | Antioxidant (wt %) |
| 4-1c | Mix of Group III and Group IV (20-80%) | MCCP (10-60%) | amine or phenol (0.01-5%) |
| 4-2c | Mix of Group III and Group IV (20-60%) | MCCP (10-60%) | amine or phenol (0.01-5%) |
| 4-3c | Mix of Group III and Group IV (30-70%) | MCCP (10-60%) | amine or phenol (0.01-5%) |
| 4-4c | Mix of Group III and polyester (20-80%) | MCCP (10-60%) | amine or phenol (0.01-5%) |
| 4-5c | Mix of Group III and polyester (30-80%) | MCCP (10-60%) | amine or phenol (0.01-5%) |
| 4-6c | Mix of Group III and polyester (30-70%) | MCCP (10-60%) | amine or phenol (0.01-5%) |
| 4-7c | Mix of Group III and polyester (40-70%) | MCCP (10-60%) | amine or phenol (0.01-5%) |
| 4-8c | Mix of Group III and polyester (35-65%) | MCCP (10-60%) | amine or phenol (0.01-5%) |
| 4-9c | Mix of Group III, PAO and polyester (20-80%) | MCCP (10-60%) | amine or phenol (0.01-5%) |
| 4-10c | Mix of Group III, PAO and polyester (30-80%)[3] | MCCP (10-60%) | amine or phenol (0.01-5%) |
| 4-11c | Mix of Group III, PAO and polyester (30-75%) | MCCP (10-60%) | amine or phenol (0.01-5%) |
| 4-12c | Mix of Group III and polyester (35-70%) | MCCP (10-60%) | amine or phenol (0.01-5%) |
| 4-13c | Mix of Group III, PAO and polyester (35-65%) | MCCP (10-60%) | amine or phenol (0.01-5%) |
| 4-14c | Mix of Group III, PAO and polyester (20-80%) | MCCP (15-45%) | amine or phenol (0.1-5%) |
| 4-15c | Mix of Group III, PAO and polyester (30-80%)[3] | MCCP (15-45%) | amine or phenol (0.1-5%) |
| 4-16c | Mix of Group III, PAO and polyester (30-75%) | MCCP (15-45%) | amine or phenol (0.1-5%) |
| 4-17c | Mix of Group III and polyester (35-70%) | MCCP (15-45%) | amine or phenol (0.1-5%) |
| 4-18c | Mix of Group III, PAO and polyester (35-65%) | MCCP (15-45%) | amine or phenol (0.1-5%) |

[1]The remaining mass are minor components, which can include, but are not limited to, an antifoaming agent (500 ppm) and a pour point depressant (0.2%).
[2]The CP in Formulation C has percentage of chlorination of between 40 to 72% by weight.

TABLE 4d

| Additional Examples of Formulation C | | | |
|---|---|---|---|
| Examples | Base Oil (wt %[1]) | Chlorinated Paraffin[2] (wt %) | Antioxidant (wt %) |
| 4-1d | Mix of Group III and Group IV (20-80%) | LCCP (10-60%) | amine or phenol (0.01-5%) |
| 4-2d | Mix of Group III and Group IV (20-60%) | LCCP (10-60%) | amine or phenol (0.01-5%) |
| 4-3d | Mix of Group III and Group IV (30-70%) | LCCP (10-60%) | amine or phenol (0.01-5%) |
| 4-4d | Mix of Group III and polyester (20-80%) | LCCP (10-60%) | amine or phenol (0.01-5%) |
| 4-5d | Mix of Group III and polyester (30-80%) | LCCP (10-60%) | amine or phenol (0.01-5%) |
| 4-6d | Mix of Group III and polyester (30-70%) | LCCP (10-60%) | amine or phenol (0.01-5%) |
| 4-7d | Mix of Group III and polyester (40-70%) | LCCP (10-60%) | amine or phenol (0.01-5%) |
| 4-8d | Mix of Group III and polyester (35-65%) | LCCP (10-60%) | amine or phenol (0.01-5%) |
| 4-9d | Mix of Group III, PAO and polyester (20-80%) | LCCP (10-60%) | amine or phenol (0.01-5%) |
| 4-10d | Mix of Group III, PAO and polyester (30-80%)[3] | LCCP (10-60%) | amine or phenol (0.01-5%) |
| 4-11d | Mix of Group III, PAO and polyester (30-75%) | LCCP (10-60%) | amine or phenol (0.01-5%) |
| 4-12d | Mix of Group III and polyester (35-70%) | LCCP (10-60%) | amine or phenol (0.01-5%) |
| 4-13d | Mix of Group III, PAO and polyester (35-65%) | LCCP (10-60%) | amine or phenol (0.01-5%) |
| 4-14d | Mix of Group III, PAO and polyester (20-80%) | LCCP (15-45%) | amine or phenol (0.1-5%) |
| 4-15d | Mix of Group III, PAO and polyester (30-80%)[3] | LCCP (15-45%) | amine or phenol (0.1-5%) |
| 4-16d | Mix of Group III, PAO and polyester (30-75%) | LCCP (15-45%) | amine or phenol (0.1-5%) |
| 4-17d | Mix of Group III and polyester (35-70%) | LCCP (15-45%) | amine or phenol (0.1-5%) |
| 4-18d | Mix of Group III, PAO and polyester (35-65%) | LCCP (15-45%) | amine or phenol (0.1-5%) |

[1]The remaining mass are minor components, which can include, but are not limited to, an antifoaming agent (500 ppm) and a pour point depressant (0.2%).
[2]The CP in Formulation C has percentage of chlorination of between 40 to 72% by weight.

Other Ingredients that May be Present in the Lubricant Additive Composition

It is conventional in the industry to add certain ingredients in a lubricant, such as an anti-wear agent, a detergent, a dispersant, a diluent, a demulsifier, an antifoam agent, a corrosion/rust inhibitor, an extreme pressure agent, a pour point depressant, a viscosity index improver, or a friction modifier.

Thus, in any of the embodiments described herein (e.g., any of the embodiments according to Formulation A, B, or C), the lubricant additive composition comprises at least one additional component (i.e., in addition to the additive base oil, CP and antioxidant(s)) selected from the group consisting of an anti-wear agent, a detergent, a dispersant, a diluent, a demulsifier, an antifoam agent, a corrosion/rust inhibitor, an extreme pressure agent, a pour point depressant, a viscosity index improver, and a friction modifier. In embodiments, the at least one additional component is in an amount of about 100 ppm to about 10% by weight of the additive composition.

Suitable anti-wear agents, detergents, dispersants, diluents, demulsifiers, antifoam agents, corrosion/rust inhibitors, extreme pressure agents, seal well agents, pour point depressants, viscosity index improvers, or friction modifiers for use in the lubricant additive composition of the invention can be any of those used in the industry. Non-limiting examples include those described below and those described in "Fuels and Lubricants Handbook Technology, Properties, Performance, and Testing," Edited by Totten, G. E., ASTM manual series; MNL 37, published in 2003.

Non-limiting anti-wear agents that can be used in the present invention include zinc dithiophosphate, metallic (e.g., Mo, Pb and Sb) salts of dithiophosphoric acid, metallic (e.g., Mo, Pb and Sb) salts of dithiocarbamic acid, metallic (e.g., Pb) salts of naphthenic acid, metallic (e.g., Pb) salts of fatty acids, boron compounds, phosphoric acid esters, phosphorous acid esters and phosphoric acid amines. Of these, phosphoric acid esters and metallic salts of dithiophosphoric acid are preferably used. Zinc dialkyl dithiophosphate (ZnDDP) are especially preferred.

Non-limiting detergents that can be used in the present invention include metal-containing detergents, such as alkali (e.g., Li, Na) or alkaline earth metal (e.g., Mg, Ca, Ba, etc.) sulfonate, phenate, salicylate or phosphonate. Examples of suitable metal-containing detergents include, but are not limited to, neutral or overbased salts of a sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a calcium sulfonate, a calcium carboxylate, a calcium salicylate, a calcium phenate, a sulfurized calcium phenate, a magnesium sulfonate, a magnesium carboxylate, a magnesium salicylate, a magnesium phenate, a sulfurized magnesium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate. Some of other known detergents suitable for use in the present invention are described in U.S. Pat. No. 7,833,952, which is herein incorporated by reference in its entirety. Preferred detergents are overbased alkali (e.g., Li, Na) or alkaline earth metal (e.g., Mg, Ca, Ba, etc.) sulfonate, phenate, salicylate or phosphonate, with a total base number (TBN) of greater than about 50, about 100, about 150, about 200, about 250, about 300, about 350, about 400, or about 450.

Non-limiting dispersants that can be used in the present invention include ashless dispersants, such as those based on polyalkenyl succinimide, polyalkenyl succinamide, benzyl amine, succinic acid ester, and succinic acid-amide, or those containing boron. Some of known ashless dispersants suitable for use in the present invention are described in U.S. Pat. No. 7,902,133, which is herein incorporated by reference in its entirety.

Non-limiting antifoam agents that can be used in the present invention include silicone containing compounds (e.g., polysiloxanes, e.g., poly dimethyl siloxane), poly(methyl)acrylates, and polyacrylates.

Non-limiting demulsifiers that can be used in the present invention include polyethylene oxide derivatives and salts of carboxylic acid and sulfonic acids.

Non-limiting extreme pressure agents that can be used in the present invention include sulphurized fat, polymer esters, polysulfides (e.g., ditertiary dodecyl polysulfide, e.g., TPS™ 20, TPS™ 32), chlorinated paraffins, and molybdenum containing compounds.

Non-limiting pour point depressants that can be used in the present invention include ethylene-vinyl acetate copolymers, polymethacrylates, and polyalkyl styrenes. Preferred pour point depressants include alkyl polymethacrylates.

Non-limiting rust inhibitors that can be used in the present invention include fatty acids, alkenyl succinic acid half esters, fatty acid soaps, alkyl sulfonates, esters of fatty acids and polyalcohols, aliphatic amines, oxidized paraffin compounds and alkyl polyoxyethylene ethers.

Non-limiting viscosity index improvers that can be used in the present invention include polyacrylate, polymethacrylate, polyisobutylene, polyolefin, polyolefin copolymers (e.g., ethylene-propylene copolymers), polyalkyl styrene (e.g., polystyrene, poly-alpha-methylstyrene), phenolic condensates, naphthalic condensates, and styrene-butadiene copolymers. Preferred viscosity index improvers include alkyl poly(methyl)acrylates. Specific examples of poly(meth)acrylates include those having 1-alkyl groups (e.g., polymethyl(meth) acrylate, polyethyl(meth)acrylate, polypropyl(meth)acrylate, polybutyl(meth)acrylate, polypentyl(meth)acrylate, polyhexyl(meth)acrylate, polyheptyl(meth)acrylate, polyoctyl(meth)acrylate, polydecyl(meth)acrylate, polylauryl (meth)acrylate, polytridecyl(meth)acrylate, polytetradecyl (meth)acrylate, polyhexadecyl(meth)acrylate, polyoctadecyl-(meth)acrylate); and those having 21-24 alkyl groups such as (meth)acrylates of higher alcohols.

Non-limiting friction modifiers that can be used in the present invention include organomolybdenum compounds, fatty acids, higher alcohols, fatty acid esters, oils and greases, (partial) esters of polyalcohols, sosorbitan esters, amines, amides, sulfided esters, phosphoric acid esters, phosphorous acid esters and phosphoric acid ester amines.

It is to be noted, however, that it is known in the art that one additive can have multifunctions in a given lubricant composition. Thus, the description and/or categorization of a certain agent (e.g., ZnDDP) above is by no means to limit the agent's function in the present invention. In addition, an additive, although labeled as a different category, if it can perform any function in a lubricant composition as described above (i.e., as an anti-wear agent, a viscosity improver, etc.), is nonetheless within the scope of the present disclosure.

Applications of the Lubricant Additive Composition

The inventors have discovered that the lubricant additive composition as described herein can be useful in various applications either as a stand-alone lubricant or as an additive to another lubricant composition.

The lubricant additive composition is especially useful in applications where lubrication is beneficial between two moving metal surfaces. Thus, in embodiments, the invention provides a lubricant comprising any of the lubricant additive composition described herein, wherein the lubricant is formulated for lubricating an object with two moving metal surfaces (e.g., a machine, an engine etc.). In addition, the lubricant additive composition is particularly useful in lubricating two moving surfaces (e.g., metal-to-metal) where high pressure is involved.

In embodiments, the invention provides an engine oil composition comprising any of the lubricant additive composition described herein. In embodiments, the invention provides lubricant composition other than an engine oil comprising any of the lubricant additive composition described herein.

Engine Oil

Engine Oil Composition

In embodiments, the invention provides an engine oil composition comprising any of the lubricant additive composition described herein. In embodiments, the lubricant additive composition is in an amount of about 3% to about 30%, about 5% to about 30%, about 5% to about 25%, about 5% to about 20%, about 5% to about 15%, about 5% to about 10%, about 8% to about 25%, about 8% to about 20%, about 8% to about 15%, about 8% to about 12%, about 6% to about 20%, about 6% to about 15%, about 6% to about 12%, or about 6% to about 10% by weight of total weight of the engine oil. In embodiments, the lubricant additive composition is in an amount of about 3%, about 5%, about 6%, about 8%, about 9%, about 10%, about 11%, about 12%, about 13%, about 14%, about 15%, about 18%, about 20%, about 25%, or about 30% by weight of total weight of the engine oil. In embodiments, the lubricant additive composition is in an amount of about 6% to about 15%, about 6% to about 12%, or about 6% to about 10% by weight of the total weight of the engine oil. In other embodiments, the lubricant additive composition is in an amount of about 8%, about 9%, about 10%, about 11%, or about 12% by weight of total weight of the engine oil.

The engine oil comprising the lubricant additive composition also comprises an engine base oil. In any of the engine oil described herein, the engine base oil can include a non-synthetic oil (e.g., a mineral oil), a synthetic oil, a blend of synthetic oils, a blend of a synthetic oil and a non-synthetic oil, or any combinations thereof, as the engine base oil. In any of the engine oil described herein, the engine base oil can also include a Group I base oil, a Group II base oil, a Group III base oil, a Group IV base oil, an ester base oil, or mixtures thereof. In embodiments, the engine base oil can also include a Group $I^+$ base oil, a Group $II^+$ base oil, or a Group $III^+$ base oil. Other suitable engine base oil are those described as suitable for use as the additive base oil.

The engine oil according to any of the embodiments described herein can include an engine base oil in an amount of about 70% to about 98%, about 75% to about 95%, about 80% to about 95%, about 85% to about 95%, about 88% to about 95%, about 88% to about 92% by weight of total weight of the engine oil. In any of the embodiments described herein, the engine base oil can also be in an amount of about 80%, about 82%, about 84%, about 86%, about 88%, about 90%, about 92%, about 94%, about 96% by weight of total weight of the engine oil. Suitable engine base oil are those described herein.

In any of the embodiments described herein, the engine oil can also include one or more additional components (i.e., in addition to the engine base oil and the lubricant additive composition) selected from the group consisting of an anti-wear agent, a detergent, a dispersant, a diluent, a demulsifier, an antifoam agent, a corrosion/rust inhibitor, an extreme pressure agent, a pour point depressant, a viscosity index improver, and a friction modifier. In embodiments, the one or more additional components include an anti-wear agent, a pour point depressant, a viscosity index improver, or a mixture thereof. Suitable agents that can be used as the additional components are those described herein (see e.g., paragraphs [0065] to [0076]). In embodiments, total amount of the one or more additional components is about 0.01% to about 5%, about 0.1% to about 5%, about 0.5% to about 5%, about 1% to about 5%, about 1% to about 3% by weight of total weight of the engine oil. In embodiments, total amount of the one or more additional components is about 0.1%, about 0.5%, about 1%, about 2%, about 3%, about 4%, or about 5% by weight of total weight of the engine oil.

Engines

The present inventors have discovered that the engine oil described herein can be formulated for use in various different engines.

In embodiments, the engine oil described herein can be formulated for an internal combustion engine. In embodiments, the internal combustion engine is a spark-ignited internal combustion engine, a compression-ignited internal combustion engine, a glow plug-ignited internal combustion engine, a two-stroke engine (e.g., lawn mowers, leaf blowers, or snowmobiles, etc.), a four-stroke engine, a six-stroke engine, jet propulsion engine, or a rotary engine (e.g., pistonless rotary engines).

In embodiments, the engine oil described herein can be formulated for a vehicle engine. In embodiments, the engine oil described herein can be formulated for an off-road engine (e.g., ATVs, Gator, etc.). In embodiments, the engine oil described herein can be formulated for an engine selected from the group consisting of a car engine, a motorcycle engine, a bus engine, a commercial vehicle engine, a boat engine, outboard motor engine, generator engine, tractor engine, nondiesel railroad engine, a jet engine, a helicopter engine, a truck engine, a marine diesel engine, a railroad diesel engine, electric vehicle engine and an aviation piston engine. In embodiments, the engine oil described herein can be formulated for a car engine. In embodiments, the car engine can be a gasoline car engine, a hybrid car engine, a biodiesel car engine, a hybrid diesel car engine, a compressed natural gas car engine, a liquid petroleum gas car engine, a diesel car engine, or any alternative fuel car engine.

In embodiments, the engine oil described herein can be formulated for a diesel engine. Suitable diesel engine can be an industrial diesel engine, or a stationary diesel engine (e.g., engines that power water irrigation). Suitable diesel engine can also be a car diesel engine, a truck diesel engine, a tractor diesel engine, a commercial vehicle diesel engine, a marine diesel engine, a generator diesel engine, or a railroad diesel engine.

In embodiments, the engine oil described herein can be formulated for a turbine engine.

In embodiments, the invention also provides an engine oil formulated for an engine selected from the group of a car engine, a motorcycle engine, a bus engine, a commercial vehicle engine, a boat engine, a jet engine, a helicopter engine, a truck engine, a marine diesel engine, a railroad diesel engine, an outboard motor engine, a generator engine, a tractor engine, a nondiesel railroad engine, an electric car engine, and an aviation piston engine, wherein the engine oil comprises about 5% to about 25% of an engine oil additive composition, wherein the additive composition comprises a) a chlorinated paraffin in an amount of about 30% to about 35% by weight of the additive composition; and b) an additive base oil in an amount of about 20% to about 40% by weight of the additive composition. Suitable chlorinated paraffin and additive base oil are those described herein. In embodiments, the additive composition further comprises one or more antioxidants in an amount of about 0.05% to about 10% by weight of the additive composition. Suitable antioxidant(s) are those described herein. In embodiments, the additive composition further comprises at least one additional component selected from the group consisting of an anti-wear agent, a detergent, a dispersant, a diluent, a demulsifier, an antifoam agent, a corrosion/rust inhibitor, an extreme pressure agent, a pour point depressant, a viscosity index improver, and a friction modifier. Suitable agents that can be used as the at least one additional component are those described herein. In embodiments, the engine oil is formulated for a car engine. In embodiments, the car engine is a gasoline car engine, a hybrid car engine, a biodiesel car engine, a hybrid diesel car engine, an electric engine, or a diesel car engine, or any alternative fuel car engine.

Engine Oil Characteristics

Engine oil with different characteristics can have different applications. In some aspects of the present invention, the present inventors have discovered that the engine oil having certain characteristics are particular desired.

Thus, in any of the embodiments described herein, the engine oil can be characterized by having one or more of the following characteristics: a) a viscosity index of between 120 and 180; b) a flash point of at least 200° C.; c) a pour point of less than −25° C.; d) a kinematic viscosity of between 9 and 17 at 100° C.; and e) an SAE API grade of XW-Y, where the X is an integer from and including 0 to 25, and Y is an integer from and including 10 to 60. The term "SAE API grade" refers to a grade determined according to standards of the Society of Automotive Engineers (SAE) and the American Petroleum Institute (API).

When the engine oil described herein is formulated for an engine that needs to be functioning properly at different temperatures, a multi-grade engine oil is especially preferred. Thus, in any of the embodiments described herein, the engine oil can be a multi-grade engine oil. In embodiments, the engine oil can be characterized as having an SAE API grade of XW-Y, where the X is an integer from and including 0 to 25, and Y is an integer from and including 10 to 60. In embodiments, the engine oil can be characterized as having an SAE API grade of 0W-10, 0W-20, 0W-30, 0W-40, 5W-10, 5W-20, 5W-30, 5W-40, 5W-50, 10W-20, 10W-30, 10W-40 10W-50, 10W-60, 15W-20, 15W-30, 15W-40, 15W-50, 15W-60, 20W-30, 20W-40, 20W-50, 20W-60, 25W-30, 25W-40, 25W-50, 25W-60, or 25W-60. In any of the embodiments described herein, the multi-grade engine oil can be formulated for a vehicle engine (e.g., a car engine, a motorcycle engine, a bus engine, a truck engine, a commercial vehicle engine, etc.).

Method of Use

In embodiments, the invention also provides a method of lubricating an engine comprising contacting the engine with any of the engine oils described herein. Suitable engines for the method include those described herein, e.g., an internal combustion engine, a turbine engine, etc.

The present inventors have also discovered that fuel efficiencies of engines can be enhanced when lubricated with an engine oil of the present invention. For example, users of the engine oil comprising the lubricant additive composition of the invention have experienced on average about 2% up to about 19% better fuel efficiency for a passenger car, a bus or a truck. Furthermore, the inventors have also discovered that the engine oil of the present invention have longer use life. Users (vehicle drivers) of the engine oil comprising the lubricant additive composition of the invention have found that oil changes can be done less frequently. Additionally, the inventors have found that the engine oil of the present invention is less likely to be consumed (e.g., burned off) by an engine. Thus, users (truck drivers) of the engine oil comprising the lubricant additive composition of the invention have found that frequent engine oil addition (due to "smoking engine" or oil burn off) is not necessary.

Thus, in embodiments, the invention also provides a method of enhancing fuel efficiency of an engine comprising providing to the engine an engine oil comprising the lubricant additive composition described herein. In embodiments, the fuel efficiency is improved by about 2 to about 5%, about 5% to about 10%, or about 10% to about 15%, or about 15% to about 19% over the fuel efficiency of the engine that is not lubricated with the engine oil comprising the lubricant additive composition described herein. In embodiments, the engine is a car engine. In embodiments, the car engine is a gasoline car engine, a hybrid car engine, a biodiesel car engine, a hybrid diesel car engine, a compressed natural gas car engine, a liquid petroleum gas car engine, an electric car engine, a diesel car engine, or any alternative fuel car engine.

Other Applications

As described above, the lubricant additive composition described herein is not limited to be used in an engine oil or for lubricating an engine. In various embodiments, the invention also provides a transmission fluid, a gear oil, a grease, a machine oil, a turbine oil, any non-soluble industrial lubrication, or a hydraulic fluid comprising any of the lubricant additive composition described herein. Suitable amount of the lubricant additive composition that can be added to the transmission fluid, the gear oil, the grease, the machine oil, the turbine oil, non-soluble industrial lubrication, or the hydraulic fluid varies, and can be in an amount of, e.g., about 1% to about 30%, or about 5% to about 25% by weight of total weight of the transmission fluid, the gear oil, the grease, the machine oil, the turbine oil, the non-soluble industrial lubrication, or the hydraulic fluid.

In embodiments, the invention provides a lubricant comprising any of the lubricant additive composition described herein, wherein the lubricant is formulated for use in machining applications or heavy industry applications. In embodiments, the invention provides a lubricant comprising any of the lubricant additive composition described herein, wherein the lubricant is formulated for use in a consumer electronic (e.g., a razor), ball bearings, drill press, lathe, an assembly line (e.g., a food assembly line), or a medical device.

EXAMPLES

All ingredients for use in the Examples described below are commercially available. Physical properties of the lubricant additive composition or the engine oil, such as total base number, density, viscosity, NOACK volatility, flash point, pour point, viscosity index, and kinematic viscosity, can be readily tested by standard procedures known to those skilled in the art.

Example 1

General Process for Preparing Lubricant Additive Composition

The lubricant additive composition described herein can be readily prepared by mixing the additive base oil, the chlorinated paraffin, the antioxidant(s), and any other ingredients. After which, the mixture is blended for about 1 to 2 hours, or more if necessary, to provide the lubricant additive composition. Heat can be applied during the mixing stage or the blending stage. In some examples, the mixture was mixed at about 60° to 70° C.

In cases where solid components are used, it is preferred to pre-mix the solid components with a liquid component (e.g., an additive base oil) first to dissolve or homogenize the solid components before mixing with the rest of the ingredients. Heat is generally applied in the pre-mixing stage. In some examples, the pre-mixing was carried out at about 100° to 110° C.

Tables 5 to 7 describes lubricant additive composition that can be prepared using the general process described above. All weight percentages in the tables can have a deviation of about ±10%.

TABLE 5

Lubricant Additive Compositions with CP-70 (short-chain)

| Components[1] | 5-1 | 5-2 | 5-3 | 5-4 | 5-5 | 5-6 | 5-7 | 5-8 | 5-9 |
|---|---|---|---|---|---|---|---|---|---|
| CP-70 | 15 | 20 | 25 | 30 | 35 | 25 | 30 | 25 | 30 |
| Base oil 1 | 75 | 70 | 65 | 60 | 55 | 37 | 32 | 35 | 30 |
| Base oil 2 | 7 | 7 | 7 | 7 | 7 | 35 | 35 | 32 | 32 |
| Base oil 3 | — | — | — | — | — | — | — | 4.9 | 4.9 |
| Antioxidant 1 | 0.5 | 0.5 | 0.5 | 0.5 | 0.5 | 0.5 | 0.5 | 0.1 | 0.1 |
| Antioxidant 2 | — | — | — | — | — | — | — | 0.5 | 0.5 |
| Anti-wear | 2 | 2 | 2 | 2 | 2 | 2 | 2 | 2 | 2 |
| Anti-friction | 0.3 | 0.3 | 0.3 | 0.3 | 0.3 | 0.3 | 0.3 | 0.3 | 0.3 |
| VI enhancer | 0.2 | 0.2 | 0.2 | 0.2 | 0.2 | 0.2 | 0.2 | 0.2 | 0.2 |
| Total (wt %)[2] | 100 | 100 | 100 | 100 | 100 | 100 | 100 | 100 | 100 |

[1]The components for the formulations of Table 5 are as follows: base oil 1 is a heavy paraffinic base oil; base oil 2 is a trimethylolpropane trioleate base oil; base oil 3 is a poly-alpha-olefin base oil; antioxidant 1 is phenyl 1-napthalene amine; antioxidant 2 is 2,2'-methylene-bis (4-methyl-6-tert-butyl phenol); anti-wear agent is overbased calcium sulfonate; anti-friction agent is ZnDDP; VI enhancer is alkyl methylacrylates copolymers.
[2]All formulations according to Table 5 include about 500 ppm silicon oil as antifoaming agent.

TABLE 6

Lubricant Additive Compositions with CP-63 (Medium-chain)

| Components[1] | 6-1 | 6-2 | 6-3 | 6-4 | 6-5 | 6-6 | 6-7 | 6-8 | 6-9 |
|---|---|---|---|---|---|---|---|---|---|
| CP-63 | 10 | 10 | 10 | 12 | 10 | 10 | 15 | 10 | 10 |
| Base oil 1 | 80.7 | 80.3 | 84.7 | 79.3 | 79.7 | 77.3 | 79.7 | 82.3 | 81.7 |
| Base oil 2 | 5 | — | 5 | — | 10 | — | 5 | — | 8 |
| Base oil 3 | 3 | 7 | — | 6 | — | 10 | — | 5 | — |
| Antioxidant 1 | 0.1 | 0.5 | 0.1 | 0.5 | 0.1 | 0.5 | 0.1 | 0.5 | 0.1 |
| Antioxidant 2 | — | — | — | — | — | — | — | — | — |
| Anti-wear | 1 | 2 | — | 2 | — | 2 | — | 2 | — |
| Anti-friction | — | — | — | — | — | — | — | — | — |
| VI enhancer | 0.2 | 0.2 | 0.2 | 0.2 | 0.2 | 0.2 | 0.2 | 0.2 | 0.2 |
| Total (wt %)[2] | 100 | 100 | 100 | 100 | 100 | 100 | 100 | 100 | 100 |

[1]The components for the formulations of Table 6 are as follows: base oil 1 is a heavy paraffinic base oil; base oil 2 is a trimethylolpropane trioleate base oil; base oil 3 is a poly-alpha-olefin base oil; antioxidant 1 is p,p'-dioctyldipheylamine; antioxidant 2 is 2,2'-methylene-bis (4-methyl-6-tert-butyl phenol); anti-wear agent is overbased calcium sulfonate; anti-friction agent is ZnDDP; VI enhancer is alkyl methylacrylates copolymers.
[2]All formulations according to Table 6 includes about 500 ppm silicon oil as antifoaming agent.

| Components[1] | 6-10 | 6-11 | 6-12 | 6-13 | 6-14 | 6-15 | 6-16 | 6-17 | 6-18[3] |
|---|---|---|---|---|---|---|---|---|---|
| CP-63 | 10 | 20 | 25 | 30 | 32.3 | 35 | 25 | 30 | 32.5 |
| Base oil 1 | 79.3 | 40 | 40 | 35 | 30 | 27 | 40 | 36 | 30 |
| Base oil 2 | — | 29.3 | 24.3 | 24.3 | 27 | 27 | 24.6 | 24.6 | 28 |
| Base oil 3 | 8 | 8 | 8 | 8 | 8 | 8 | 8 | 7 | 7 |
| Antioxidant 1 | 0.5 | 0.5 | 0.5 | 0.5 | 0.5 | 0.3 | 0.1 | 0.1 | 0.1 |
| Antioxidant 2 | — | | | | | 0.5 | 0.5 | 0.5 | 0.5 |
| Anti-wear | 2 | 2 | 2 | 2 | 2 | 2 | 0.1 | 0.1 | 0.1 |
| Anti-friction | — | — | — | — | — | — | 1.5 | 1.5 | 1.5 |
| VI enhancer | 0.2 | 0.2 | 0.2 | 0.2 | 0.2 | 0.2 | 0.2 | 0.2 | 0.2 |
| Total (wt %)[2] | 100 | 100 | 100 | 100 | 100 | 100 | 100 | 100 | 100 |

[1]The components for the formulations in Table 6 are as follows: base oil 1 is a heavy paraffinic base oil; base oil 2 is a trimethylolpropane trioleate base oil; base oil 3 is a poly-alpha-olefin base oil; antioxidant 1 is p,p'-dioctyldipheylamine; antioxidant 2 is 2,2'-methylene-bis (4-methyl-6-tert-butyl phenol); anti-wear agent is overbased calcium sulfonate; anti-friction agent is ZnDDP; VI enhancer is alkyl methylacrylates copolymers.
[2]All formulations according to Table 6 includes about 500 ppm silicon oil as antifoaming agent.
[3]Formulation 6-18 also includes alkyl methylacrylates copolymers as a pour point depressor (0.1%).

| Components[1] | 6-19 | 6-20[3] | 6-21[4] | 6-22[5] | 6-23[6] | 6-24 | 6-25 | 6-26[7] | 6-27[8] |
|---|---|---|---|---|---|---|---|---|---|
| CP-63 | 35 | 20 | 25 | 30 | 32.5 | 35 | 30 | 32.5 | 35 |
| Base oil 1 | 29 | 40 | 40 | 35 | 30 | 28 | 28 | 29 | 28 |
| Base oil 2 | 26.6 | 35 | 17.4 | 17 | 26.6 | 21.6 | 21.6 | 22 | 24 |
| Base oil 3 | 7 | 2 | 15 | 15 | 7 | 12 | 12 | 7 | 10 |

TABLE 6-continued

| Lubricant Additive Compositions with CP-63 (Medium-chain) | | | | | | | | | |
|---|---|---|---|---|---|---|---|---|---|
| Antioxidant 1 | 0.1 | 0.1 | 0.1 | 0.1 | 0.1 | 0.1 | 0.1 | 0.1 | 0.5 |
| Antioxidant 2 | 0.5 | 1.5 | 0.5 | 1.5 | 2 | 0.5 | 2 | 2 | 0.5 |
| Anti-wear | 0.1 | 0.3 | 0.1 | 0.1 | 0.1 | 0.3 | 0.3 | 1 | 0.3 |
| Anti-friction | 1.5 | 0.9 | 0.9 | 0.3 | 0.3 | 1.5 | 5 | 5 | 1.5 |
| VI enhancer | 0.2 | 0.2 | 1 | 1 | 1 | 1 | 1 | 1 | 0.2 |
| Total (wt %)[2] | 100 | 100 | 100 | 100 | 100 | 100 | 100 | 100 | 100 |

[1]The components for the formulations of Table 6 are as follows: base oil 1 is a heavy paraffinic base oil; base oil 2 is a trimethylolpropane trioleate base oil; base oil 3 is a poly-alpha-olefin base oil; antioxidant 1 is p,p'-dioctyldipheylamine; antioxidant 2 is 2,2'-methylene-bis (4-methyl-6-tert-butyl phenol); anti-wear agent is overbased calcium sulfonate; anti-friction agent is ZnDDP; VI enhancer is alkyl methylacrylates copolymers.
[2]All formulations according to Table 6 includes about 500 ppm silicon oil as antifoaming agent.
[3]Antioxidant 1 in formulation 6-20 is styrenated diphenyl amine.
[4]Antioxidant 2 in formulation 6-21 is 4,4'-methylene-bis(2,6-di-tert-butylphenol).
[5]The anti-wear agent in formulation 6-22 is overbased calcium phenate.
[6]Formulation 6-23 also includes alkyl methylacrylates copolymers as a pour point depressor (0.4%).
[7]Formulation 6-26 also includes alkyl methylacrylates copolymers as a pour point depressor (0.5%).

TABLE 7

| Lubricant Additive Compositions with other CPs | | | | | | | | | |
|---|---|---|---|---|---|---|---|---|---|
| Components[1] | 7-1[3] | 7-2[4] | 7-3[5] | 7-4[6] | 7-5[7] | 7-6[8] | 7-7[9] | 7-8[10] | 7-9[11] |
| CP | 35 | 20 | 25 | 30 | 32.5 | 10 | 10 | 12 | 15 |
| Base oil 1 | 29 | 40 | 40 | 35 | 30 | 80.3 | 84.7 | 79.3 | 79.7 |
| Base oil 2 | 26.6 | 35 | 17.4 | 17 | 26.6 | — | 5 | — | 5 |
| Base oil 3 | 7 | 2 | 15 | 15 | 7 | 7 | — | 6 | — |
| Antioxidant 1 | 0.1 | 0.1 | 0.1 | 0.1 | 0.1 | 0.1 | 0.1 | 0.5 | 0.1 |
| Antioxidant 2 | 0.5 | 1.5 | 0.5 | 1.5 | 2 | — | — | — | — |
| Anti-wear | 0.1 | 0.3 | 0.1 | 0.1 | 0.1 | 2 | — | 2 | — |
| Anti-friction | 1.5 | 0.9 | 0.9 | 0.3 | 0.3 | — | — | — | — |
| VI enhancer | 0.2 | 0.2 | 1 | 1 | 1 | 0.2 | 0.2 | 0.2 | 0.2 |
| Total (wt %)[2] | 100 | 100 | 100 | 100 | 100 | 100 | 100 | 100 | 100 |

[1]The components for the formulations of Table 7 are as follows: base oil 1 is a heavy paraffinic base oil; base oil 2 is a trimethylolpropane trioleate base oil; base oil 3 is a poly-alpha-olefin base oil; antioxidant 1 is p,p'-dioctyldipheylamine; antioxidant 2 is 2,2'-methylene-bis (4-methyl-6-tert-butyl phenol); anti-wear agent is overbased calcium sulfonate; anti-friction agent is ZnDDP; VI enhancer is alkyl methylacrylates copolymers.
[2]All formulations according to Table 7 includes about 500 ppm silicon oil as antifoaming agent.
[3]The CP in formula 7-1 is CP-60.
[4]The CP in formula 7-2 is CP-56 and antioxidant 1 in formulation 7-2 is styrenated diphenyl amine.
[5]The CP in formula 7-3 is CP-52 and antioxidant 2 in formulation 7-3 is 4,4'-methylene-bis(2,6-di-tert-butylphenol).
[6]The CP in formulation 7-4 is CP-50 and the anti-wear agent in formulation 7-4 is overbased calcium phenate.
[7]The CP in formulation 7-5 is CP-60; and formulation 7-5 also includes alkyl methylacrylates copolymers as a pour point depressor (0.4%).
[8-11]The CP in formulations 7-6 to 7-11 are also CP-60.

Example 2

General Process for Preparing an Engine Oil Composition

Engine oil described herein can be readily prepared by first mixing the lubricant additive composition, such as those disclosed in Example 1, an engine base oil, and any additional component(s). After which, the mixture is blended for about 1 to 2 hours, or more if necessary, to provide the engine oil. Heat can be applied during the mixing stage or the blending stage. In some examples, the blending was carried out at about 60° to 70° C.

Any of the lubricant additive composition described in Example 1 can be blended with an engine base oil (e.g., a Group II base oil) in a ratio of 1:9 (lubricant additive composition:engine base oil) by weight. In some examples, additional components such as a viscosity index enhancer (e.g., Lubrizol 7075) in the amount of less than 5 wt % can be added to the mixture. In some examples, commercially available engine stock oil (i.e., premixed engine base oil with an additive package) can be used in lieu of the engine base oil. For example, an engine oil can be prepared by blending about 8% by weight of the lubricant additive composition described in Example 1 and about 92% by weight of a commercially available engine stock oil comprising a Group II base oil. In some examples, about 2% by weight of Lubrizol 7075 can also be added.

What is claimed is:

1. A lubricant additive composition comprising:

a) three different kinds of additive base oil, wherein the total weight of the additive base oil is in an amount of about 50% to about 80% by weight of the additive composition;

b) a chlorinated paraffin in an amount of about 15% to about 45% by weight of the additive composition; and c) two antioxidants, wherein the three additive base oils comprise a trimethylolpropane trioleate base oil in an amount of about 20% to about 40% by weight of the additive composition; a Group III base oil in an amount of about 20% to about 40% by weight of the additive composition; and a poly-alpha-olefin base oil; and wherein the two antioxidants comprise p,p'-dioctyldiphenylamine in an amount of about 0.1% to about 1% by weight of the additive composition; and 2,2'-methylene-bis(4-methyl-6-tert-butyl phenol) in an amount of about 0.1% to about 3% by weight of the additive composition.

2. The lubricant additive composition of claim 1, wherein the Group III base oil is a paraffinic base oil.

3. The lubricant additive composition of claim 1, wherein the weight ratio of 2,2'-methylene-bis(4-methyl-6-tert-butyl phenol) to p,p'-dioctyldiphenylamine is about 15:1 to about 25:1.

4. A lubricant additive composition comprising:

a) an additive base oil in an amount of about 20% to about 40% by weight of the additive composition;

b) a chlorinated paraffin in an amount of about 15% to about 45% by weight of the additive composition;

c) p,p'-dioctyldiphenylamine in an amount of about 0.1% to about 1% by weight of the additive composition; and d) 2,2'-methylene-bis(4-methyl-6-tert-butyl phenol) in an amount of about 0.1% to about 3% by weight of the additive composition;

e) a polyester base oil in an amount of about 20% to about 40% by weight of the additive composition; and f) a poly-alpha-olefin base oil, wherein the weight ratio of 2,2'-methylene-bis(4-methyl-6-tert-butyl phenol) to p,p'-dioctyldiphenylamine is 1:1 to 50:1; and wherein the additive base oil is characterized by having a viscosity index of about 120 to about 180.

5. The lubricant additive composition of claim 4, wherein the additive base oil is a paraffinic base oil.

6. The lubricant additive composition of claim 4, wherein the polyester base oil is a trimethylolpropane trioleate base oil.

7. The lubricant additive composition of claim 4, wherein the additive base oil is not a naphthenic base oil.

* * * * *